US007156566B2

(12) United States Patent
Johnson et al.

(10) Patent No.: US 7,156,566 B2
(45) **Date of Patent: *Jan. 2, 2007**

(54) THERMAL PRINTING AND CLEANING ASSEMBLY

(75) Inventors: Jennifer Johnson, Middleport, NY (US); Daniel J. Harrison, Pittsford, NY (US); Jim Ventola, Buffalo, NY (US); Barry L. Marginean, Scottsville, NY (US); Dennis Gambon, Woodstock, GA (US)

(73) Assignee: International Imaging Materials, Inc., Amherst, NY (US)

( * ) Notice: Subject to any disclaimer, the term of this patent is extended or adjusted under 35 U.S.C. 154(b) by 85 days.

This patent is subject to a terminal disclaimer.

(21) Appl. No.: 11/013,810

(22) Filed: Dec. 16, 2004

(65) Prior Publication Data

US 2005/0128280 A1 Jun. 16, 2005

Related U.S. Application Data

(63) Continuation-in-part of application No. 10/982,256, filed on Nov. 5, 2004, which is a continuation of application No. 10/737,353, filed on Dec. 16, 2003, now Pat. No. 6,908,240.

(51) Int. Cl.
*B41J 31/05* (2006.01)
*B41J 31/06* (2006.01)

(52) U.S. Cl. ..... 400/238; 400/237; 400/241; 400/241.1

(58) Field of Classification Search ..... None
See application file for complete search history.

(56) References Cited

U.S. PATENT DOCUMENTS 3,523,818 A * 8/1970 Blumenthal ..... 427/378
3,658,631 A * 4/1972 Shaw et al. ..... 428/415
3,691,140 A 9/1972 Silver
3,823,947 A 7/1974 Sasaki
3,827,699 A 8/1974 Waugh
3,857,731 A 12/1974 Merrill, Jr.
3,924,043 A 12/1975 Gobran
4,029,368 A 6/1977 Tschirky
4,138,229 A 2/1979 Tadokoro
4,166,152 A 8/1979 Baker (Continued)

FOREIGN PATENT DOCUMENTS

JP 60212379 A 10/1985

(Continued)

OTHER PUBLICATIONS

Machine translation of JP 5-139003 to Yamaguchi et al. from Japanese Patent Office website.*
Machine translation of JP 9-202023 to Shintani et al. from Japaense Patent Office website.*
U.S. Appl. No. 09/321,020, filed Oct. 28, 1993, Wiklof.
U.S. Appl. No. 09/700,781, filed Jan. 9, 1997, Ashley.

(Continued)

*Primary Examiner*—Daniel J. Colilla
(74) *Attorney, Agent, or Firm*—Howard J. Greenwald

(57) ABSTRACT

A thermal printing assembly comprised of a first flexible section and a second flexible section joined to such first flexible section. The first section of such assembly is a thermally sensitive media that contains either a thermal transfer ribbon, a dye sublimation ribbon, or a direct thermal sensitive substrate (such as thermal paper); the thermally sensitive media is adapted to change its concentration of ink upon the application of heat. The second section of such assembly is a flexible support with two sides, at least one of which has a smoothness of less than 50 Sheffield Units and contains particles with a Knoop hardness of less than about 800 and the other side has an adhesive coating designed to remove dirt and debris from surfaces it contacts during use.

60 Claims, 13 Drawing Sheets

U.S. PATENT DOCUMENTS 4,287,264 A 9/1981 Marginean
4,289,535 A 9/1981 Marginean
4,304,700 A 12/1981 Shimp
4,369,456 A 1/1983 Cruz-Uribe
4,422,119 A 12/1983 Kawakami
4,446,205 A 5/1984 Mizuno
4,476,177 A 10/1984 Mizuno
4,495,318 A 1/1985 Howard
4,497,851 A 2/1985 de Vroom
4,536,218 A 8/1985 Ganho
4,598,112 A 7/1986 Howard
4,644,370 A 2/1987 Watanabe
4,645,783 A 2/1987 Kinoshita
4,656,218 A 4/1987 Kinoshita
4,675,705 A 6/1987 Marginean
4,737,252 A 4/1988 Hoffman
4,786,696 A 11/1988 Bohnel
4,834,739 A 5/1989 Linker, III
4,873,078 A 10/1989 Edmundson
4,933,015 A 6/1990 White
4,988,567 A 1/1991 Delgado
4,994,322 A 2/1991 Delgado
5,011,480 A 4/1991 Gossens
5,015,608 A 5/1991 Matsuhisa
5,045,569 A 9/1991 Delgado
5,108,834 A 4/1992 Asazuma
5,118,750 A 6/1992 Silver
5,213,588 A 5/1993 Wong
5,227,226 A 7/1993 Rzasa
5,271,990 A 12/1993 Kronzer
5,316,344 A 5/1994 Popat
5,358,402 A 10/1994 Reed
5,378,676 A 1/1995 Defieuw
5,389,129 A 2/1995 Jordan
5,416,058 A 5/1995 Uyttendaele
5,451,559 A 9/1995 Smith
5,472,058 A 12/1995 Hooper
5,474,966 A 12/1995 Asazuma
5,525,417 A 6/1996 Eyler
5,536,328 A 7/1996 Morgavi
5,536,627 A 7/1996 Wang
5,537,140 A 7/1996 Hayashi
5,547,914 A 8/1996 De Meutter
5,551,960 A 9/1996 Christianson
5,563,646 A 10/1996 Fukuda
5,569,347 A 10/1996 Obata
5,573,693 A 11/1996 Lorence
5,582,953 A 12/1996 Uyttendaele
5,587,350 A 12/1996 Horsten
5,648,425 A 7/1997 Everaerts
5,663,241 A 9/1997 Takamatsu
5,665,462 A 9/1997 Dewar
5,665,472 A 9/1997 Tanaka
5,672,428 A 9/1997 Muschelweicz
5,672,561 A 9/1997 Shinohara
5,688,060 A 11/1997 Terao
5,716,717 A 2/1998 Yeung
5,716,900 A 2/1998 Kronzer
5,776,280 A 7/1998 Puckett
5,865,548 A 2/1999 Wen
5,875,719 A 3/1999 Francis
5,891,294 A 4/1999 Shih
5,891,476 A 4/1999 Reo
5,917,530 A 6/1999 Hutt
5,926,197 A 7/1999 Kessler
5,936,816 A 8/1999 Bloomquist
5,965,244 A 10/1999 Tang
5,975,988 A 11/1999 Christianson
5,981,058 A 11/1999 Shih
5,985,076 A 11/1999 Misuda
5,985,424 A 11/1999 DeMatte
5,995,126 A 11/1999 Imai
5,997,227 A 12/1999 Bundy
6,008,157 A 12/1999 Takeuchi
6,010,259 A 1/2000 Hadley
6,013,409 A 1/2000 Chou
6,024,950 A 2/2000 Takada
6,028,614 A 2/2000 Clark
6,031,021 A 2/2000 Kenny
6,031,556 A 2/2000 Tutt
6,045,646 A 4/2000 Yoshikawa
6,051,097 A 4/2000 Higuchi
6,051,171 A 4/2000 Takeuchi
6,060,234 A 5/2000 Katz
6,071,585 A 6/2000 Roth
6,074,100 A 6/2000 Rowland
6,078,346 A 6/2000 Isobe
6,082,912 A 7/2000 Shimizu
6,083,610 A 7/2000 Hirose
6,083,872 A 7/2000 Adkins
6,084,623 A 7/2000 Shibasaki
6,086,700 A 7/2000 Valentini
6,086,987 A 7/2000 Yamanaka
6,090,747 A 7/2000 Dronzek
6,102,534 A 8/2000 Herbert
6,103,389 A 8/2000 Tanaka
6,113,725 A 9/2000 Kronzer
6,114,088 A 9/2000 Wolk
6,116,709 A 9/2000 Hirabayashi
6,117,572 A 9/2000 Tidrow
6,118,467 A 9/2000 Park
6,121,356 A 9/2000 Lundberg
6,124,239 A 9/2000 Chapman
6,124,944 A 9/2000 Ohta
6,127,316 A 10/2000 Chapman
6,195,111 B1 2/2001 Nelson
6,210,490 B1 4/2001 Michael et al.
6,284,425 B1 9/2001 Staral et al.
6,332,953 B1 12/2001 Singh et al.
6,362,131 B1 3/2002 Horii et al.
6,619,869 B1 9/2003 Huang et al.
6,890,112 B1 * 5/2005 Kline ..... 400/615.2
2002/0160160 A1 10/2002 Suzuki
2003/0089450 A1 5/2003 Lin
2004/0017458 A1 1/2004 Conwell
2004/0121068 A1 6/2004 Bellmann

FOREIGN PATENT DOCUMENTS

JP 62286789 A2 12/1987
JP 02045184 A 2/1990
JP 5116428 A2 5/1993
JP 5139003 A2 6/1993
JP 09202023 A 8/1997
JP 10226097 A2 8/1998
JP 10296933 A2 11/1998
JP 2001213024 8/2001
JP 2002166666 A 6/2002

OTHER PUBLICATIONS

Avery Dennison; "Headsaver Clean-Strip", Apparent Product Information Sheet, Date prior to Dec. 8, 2003.
Sato; "Using the Cleaning Sheet", Apparent Product Information Sheet, Date prior to Dec. 8, 2003.
HTP Plastics Inc.; "Highly Filled Polyolefin Firms with Imrpoved Barrier . . . " http://www.hptplastics.com/fpo_presentation.html, Date prior to Dec. 8, 2003.
Schut, Jan H.; "The New Look in Plastics—It's Paper!", http://www.plasticstechnology.com/articles/200002fa1.html, Feb. 2000.
Avery Dennison, "Foils/Ribbons" http://www.novexx.com/search/queryhit.idq?CiRestriction=cleaning+tape&gobutton2.x=9&gobutton2.y=20; Date Apr. 16, 2003.

* cited by examiner

THERMAL PRINTING AND CLEANING ASSEMBLY

CROSS-REFERENCE TO RELATED PATENT APPLICATIONS

This application is a continuation-in-part of patent application U.S.S.N. 10/982,256 filed on Nov. 5, 2004, which is a continuation of patent application U.S.S.N. 10/737,353, filed on Dec. 16, 2003, now U.S. Pat. No. 6,908,240. The entire content of each of these patent applications is hereby incorporated by reference into this specification.

FIELD OF THE INVENTION

A thermal printing assembly comprised of a flexible printing section joined to a flexible cleaning section.

BACKGROUND OF THE INVENTION

As is known to those skilled in the art, there are two well-known methods of thermal printing: thermal transfer printing, and direct thermal printing. Although the thermal printing assembly of this invention is applicable to both such methods, for the sake of simplicity of discussion most of this specification will be devoted to describing the use of such assembly in thermal transfer printing.

Thermal transfer printers are well known to those skilled in the art and are described, e.g., in International Publication No. WO 97/00781, published on Jan. 7, 1997, the entire disclosure of which is hereby incorporated by reference into this specification. As is disclosed in this publication, a thermal transfer printer is a machine that creates an image by melting ink from a film ribbon and transferring it at selective locations onto a receiving material. Such a printer normally comprises a print head including a plurality of heating elements that may be arranged in a line. The heating elements can be operated selectively.

Alternatively, one may use one or more of the thermal transfer printers disclosed in U.S. Pat. Nos. 6,124,944; 6,118,467; 6,116,709; 6,103,389; 6,102,534; 6,084,623; 6,083,872; 6,082,912; 6,078,346; and the like. The disclosure of each of these United States patents is hereby incorporated by reference into this specification.

It is well know that print heads in thermal transfer printers become fouled with usage; see, for example, U.S. Pat. No. 5,688,060. The operation of such print heads involves the resistive heating of selected print head elements to temperatures above 200 degrees Celsius in order to facilitate the thermal transfer of an imaging ink from a donor ribbon to a receiving sheet. As the donor ribbon is transported across the print head during the imaging process, selected areas of the ribbon are in turn heated by the energized print head elements. With usage, a build up of contaminates accumulates on the print head. Some of these contaminates may be from the ribbon itself. Additionally, contaminants that accumulate on any component that comes in contact with the printhead can be transferred to the printhead resulting in the same issue of degrading print quality with build-up. One component particularly at risk for such transfer is the drive roller or platen used to drive and/or support the media during the printing process.

Some thermal transfer printers have automatic print head cleaning devices integrated into them; see for example such U.S. Pat. No. 5,688,060 of Terao. In this patent it is disclosed that in "a thermal transfer printer in which when a printing head is soiled, the debris on the printing head can be removed automatically. The printing head movable to and from a platen is mounted on a carriage capable of being reciprocated along the platen, and a cleaning pad is disposed on an extension line of the platen downstream or upstream in the printing column direction of the platen" (see column 2). Such cleaning pads typically are saturated with solvents such as isopropyl alcohol and need to be frequently replenished.

Other print head cleaning systems utilize pouches of organic solvent integrated into the thermal transfer media. See, for example, U.S. Pat. No. 5,875,719 of Francis in which is disclosed a "cleaning apparatus for cleaning the print head of a baggage tag printer used for printing passenger identification and destination indicia thereon. The print head cleaner comprises a plurality of baggage tags secured to one another in end-to-end relation forming an elongated strip of baggage tags. The cleaner is secured to the last of the tags for automatic advancement into the printer upon completion of the printing of the final tag. The cleaner includes a quantity of print head cleaning fluid enclosed in a pouch which bursts upon passage through the printer. A paper tail may be fastened to the pouch for frictional engagement with the print head facilitating the cleaning thereof" (see columns 2 and 3 of such patent). Such systems are complex to manufacture. Thermal media is typically prepared by spooling the media onto a cylindrical core. If the cleaning pouch is placed at the end of the media, directly adjacent to the core, then it will be subjected to relatively high winding pressures, thereby placing it at risk of busting before usage. If the cleaning pouch is placed at the start of the media, then there is a danger that the cleaning solvent will spread onto the thermal media and damage it prior to use of the media. In addition, such cleaning pouches are designed to burst and, thus, may be easily broken before usage, potentially damaging the thermal media before its usage.

Methods for cleaning print heads are also discussed in U.S. Pat. No. 5,525,417 of Eyler, the entire disclosure of which is hereby incorporated by reference into this specification. According to this Eyler patent, "one conventional method for cleaning the heads, sensors, and/or rollers is to use a cleaning card. The cleaning card has the approximate dimensions of the data-carrying card. Typically, cleaning cards are constructed as a laminate of a semirigid core of acrylic, PVC, PET, or ABS plastic material or the like, with nonwoven fibers of a soft substantially nonabrasive material chemically bonded to both of the side surfaces thereof. The cleaning card may be presaturated with a solvent or the solvent may be added just prior to use of the cleaning card. Unfortunately, the chemical bonding process includes binders, adhesives, and other materials which are necessary for the lamination process, but which, in the presence of the solvents required for cleaning, will deteriorate and thus undermine the structural integrity of the card. A non-laminated cleaning card has been described in U.S. Pat. No. 5,227,226 to Rzasa. The non-laminated cleaning card is porous allowing penetration of the cleaning solvent. If the equipment is exposed to such cleaning solvent for too long a period of time, the equipment may be deleteriously affected. Moreover, conventional cleaning cards often disadvantageously introduce static into the equipment" (see columns 1 and 2 of such patent).

In U.S. Pat. No. 5,525,417, Eyler disclosed a two part cleaning card for removing contamination from print heads and other devices. "The cleaning card comprises, generally, a flat, semi-rigid base with a first material mechanically bonded to a first side surface and a second material mechanically bonded to a second side surface thereof. The mechanical bonding process is also claimed. In a preferred form of the invention, the cleaning card provides a way to make the cleaning of equipment quicker and effective for removing stubborn contaminates. The base includes a flat, semi-rigid generally rectangular piece of acrylic, PVC, PET, or ABS or the like plastic material. The base is generally sized to conform to the same dimensions of the card, which carries the data and may be colored to increase its opacity and thus its ability to be accepted into some equipment. In a first preferred embodiment, the first material mechanically bonded to a first side surface is substantially abrasive. One example is Reemay.R™. from Reemay, a nonwoven spunbonded polyester. This material is substantially impenetrable to restrict absorption of a cleaning solvent. The second material mechanically bonded to a second surface comprises a spunlaced nonwoven fabric such as DuPont's Sontara.R™. which is soft, substantially nonabrasive, lightweight, and drapable. This material is substantially penetrable to improve absorption of the cleaning solvent. In an alternative embodiment, the abrasive first material is 3M Imperial Lapping Film, also a substantially impenetrable material" (see columns 2 and 3 of such patent).

U.S. Pat. No. 5,525,417 also discloses that "Another conventional method is to remove the contaminants by wiping the surface of the heads and rollers with a soft paper or rag impregnated with a cleaning solvent. In this case, however, it is necessary to disassemble the equipment for exposing the rollers and heads" (see column 2 of such patent).

Such abrasive cleaning cards, as described, e.g., in U.S. Pat. No. 5,525,417, often damage the print head by scratching the elements of the print head during the process of abrading away debris or contamination on the print head. In addition, if it is necessary to use solvents in the cleaning of the print head, the process will be both inconvenient and potentially dangerous. Due to the flammable nature of many solvents and the static which may be generated when handling thermal media, the potential for fire or explosions is real. Many other patents disclose the use of abrasive substrates or solvents to clean various types of print heads. See, for example, U.S. Pat. Nos. 5,563,646; 5,536,328; 4,933,015; 5,926,197; 6,210,490; 5,227,226; and 6,028,614; the disclosure of each of these United States patents is hereby incorporated by reference into this specification.

Print head cleaning cards, such as the Sato Thermal Printer Cleaning Sheet available from Sato America, 10350A Nations Ford Road, Charlotte, N.C. 28273, are based on abrasive lapping films. These cleaning cards are comprised of a film with at lease one rough abrasive surface. The abrasive particles on this surface are strongly bound to the surface. These films typically have a Sheffield smoothness greater than 60.

According to Shinji Imai, in his U.S. Pat. No. 5,995,126, "The lapping film has an abrasive such as alumina particles buried in the surface of a substrate film and the deposits adhering tenaciously to the surface of the thermal head can be scraped off by delivering this lapping film in place of the thermal material. However, the abrasive effect of the lapping film is so great as to remove the protective ceramic coating on the thermal head and, hence, the thermal head will wear prematurely before the end of its expected service life" (see column 1 of such patent).

It is an object of this invention to provide a means of cleaning a printhead and a backing roller or platen simultaneously without damaging them.

SUMMARY OF THE INVENTION

In accordance with this invention, there is provided a thermal printing assembly comprised of at least two flexible sections joined together. At least one section of such assembly is a thermally sensitive media that is comprised of a thermal transfer ribbon, a dye sublimation ribbon, or a direct thermal sensitive substrate (such as thermal paper); the thermally sensitive media is adapted to either change color or induce a color change to a receiver upon the application of heat. One or more other sections of such assembly are flexible supports with two sides, at least one side of which has a smoothness of less than 100 Sheffield Units and is comprised of particles with a Knoop hardness of less than about 800. Additionally, one or more other sections have a second side coated with an adhesive material.

BRIEF DESCRIPTION OF THE DRAWINGS

The invention will be described by reference to this specification and the attached drawings, in which like numerals refer to like elements, and in which.

DESCRIPTION OF THE PREFERRED EMBODIMENTS

Maintenance and cleaning of the thermal print heads of digital thermal printers is desirable for optimum system performance. Similarly, cleaning of the drive roll or printing platen is desirable for optimum printing performance. Applicants have discovered that smooth, non-abrasive substrates can provide a novel method for cleaning thermal print heads without damaging the print head itself. Additionally, applying an adhesive material to the side of the substrate in contact with the roller removes substantial debris from the roller or platen that provides the pressure in the printing nip, eliminating the possibility of transfer of this debris to the printhead itself.

Figure 1:
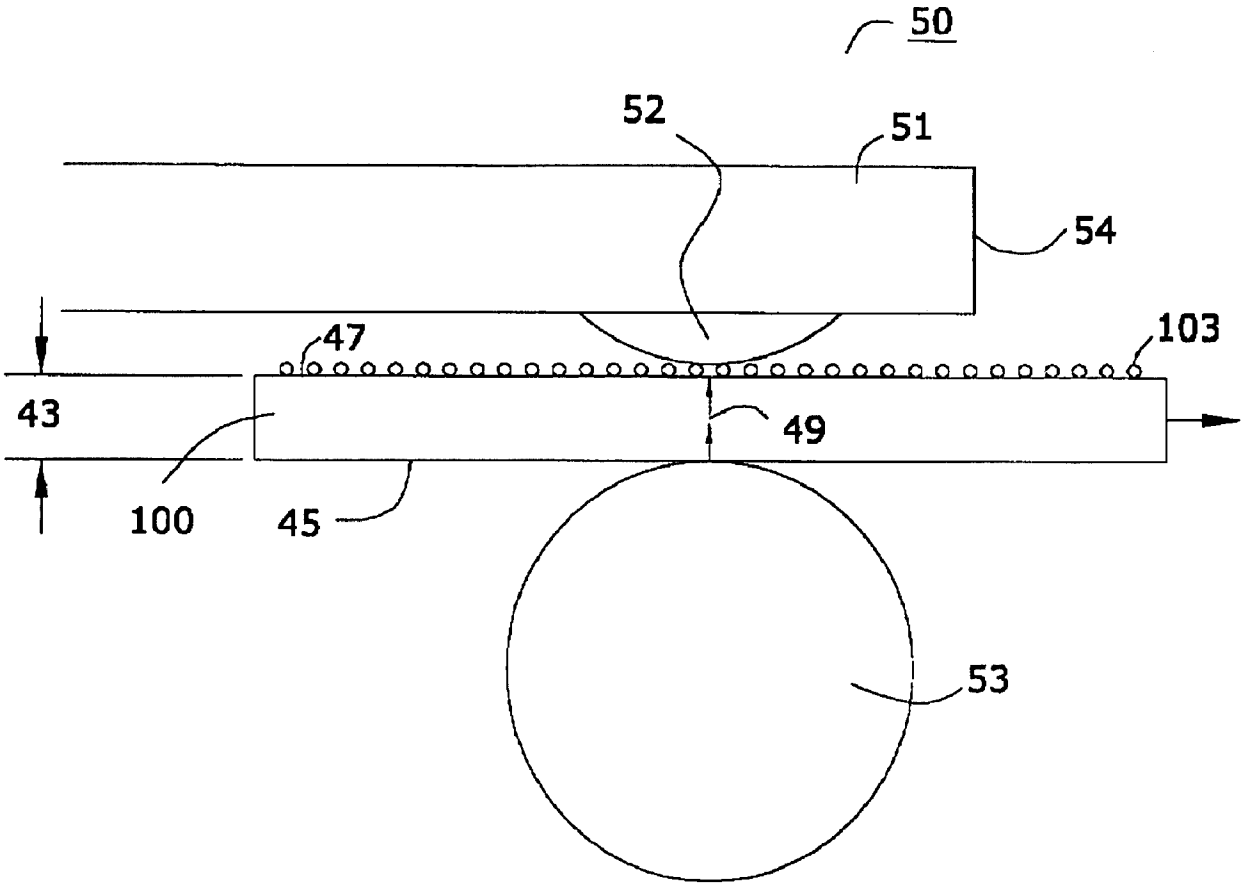
FIG. 1 is a cross sectional representation of a thermal printing nip.

FIG. 1 depicts the cross sectional structure of a digital thermal printer printing nip assembly 50. The nip 49 is formed between a thermal print head 54 and a platen roller 53. The print head 54 is comprised of a rigid base 51 and a heating element array 52. In one embodiment, heating element array 52 is comprised of an array of individual heaters, each of which is individually controllable by the digital thermal printer (not shown).

Referring again to FIG. 1, and to the preferred embodiment depicted therein, a non-abrasive cleaning film 100 is placed in the nip 49 formed between the print head 54 and the printing platen roller 53 of a digital thermal printer (not shown). Such films 100 are preferably comprised of loosely held soft particles 103. Without wishing to be bound to any particular theory, applicants believe that such soft particles 103 facilitate the cleaning of the print head through a polishing action, which occurs when the cleaning film 100 is pulled across the array 52 of a thermal print head 54 in a thermal printing nip 49 as depicted in FIG. 1.

The soft particles 103 preferably have a particle size distribution such that at least about 90 weight percent of such particles have a maximum cross-sectional dimension (such as, e.g., a maximum diameter) of less than about 100 microns and, preferably, less than about 50 microns. In one embodiment, at least 95 weight percent of such particles are smaller than about 25 microns and, even more preferably, are smaller than about 15 microns.

The soft particles 103 preferably have a Knoop hardness of less than about 800. As is known to those skilled in the art, hardness is the resistance of a material to deformation of an indenter of specific size and shape under a known load. The most generally used hardness scales of Brinell (for cast iron), Rochwell (for sheet metal and heat-treated steel), diamond, pyramid, Knoop, and sclero-scope (for metals).

The Knoop hardness test, and means for conducting it, are well known to those skilled in the art. Reference may be had, e.g., to U.S. Pat. Nos. 5,472,058; 5,213,588; 5,551,960; 5,015,608; 6,074,100; 5,975,988; 5,358,402; 4,737,252; 4,029,368; and the like. The entire disclosure of each of these United States patents is hereby incorporated by reference into this specification.

In one preferred embodiment, and referring again to FIG. 1, the soft particles 103 preferably have a Knoop hardness of less than about 500 and, even more preferably, a Knoop hardness of less than about 300. In one especially preferred embodiment, the Knoop hardness of the soft particles 103 is preferably less than about 150.

Referring again to FIG. 1, and to the preferred embodiment depicted therein, it will be seen that cleaning film 100 is comprised of opposed surfaces 45 and 47; surface 47 is preferably the one that contacts print head 54 and the array of heating elements 52 thereon. In the embodiment depicted in FIG. 1, the surface 47 is comprised of a multiplicity of soft particles 103.

The soft particles 103 are preferably integrally connected to and embedded within the surface 47; these soft particles 47, together with the matrix within which they are preferably embedded, form the surface 47. As is illustrated in FIG. 1, at least some of the soft particles 103 extend above the matrix in which they are embedded.

A sufficient number of such soft particles are present on surface 47, and/or extend above the matrix in which they are embedded to effect cleaning of the print head 54. In general, at least about 100 such particles 103 per square millimeter of surface 47 are present on the surface 47 and are preferably homogeneously distributed over such surface 47. In one embodiment, at least about 500 of such particles 103 are present per square millimeter of such surface 47 and are preferably homogeneously distributed over such surface 47. In yet another embodiment, at least about 1000 of such particles 103 are present for each square millimeter of such surface 47 and are preferably homogeneously distributed over such surface.

Referring again to FIG. 1, the surface 47 preferably has a Sheffield smoothness of less than about 50. As is known to those skilled in the art, means for determining Sheffield smoothness are well known. Reference may be had, e.g., to U.S. Pat. No. 4,834,739 (external feminine protection device); U.S. Pat. No. 5,011,480 (absorbent article having a non-woven frictional surface); U.S. Pat. Nos. 5,451,559; 5,316,344 (stationary with removable printable labels); U.S. Pat. Nos. 5,271,990; 5,716,900; 6,332,953; 5,985,424; and the like. The entire disclosure of each of these United States patents is hereby incorporated by reference into this specification.

In one preferred embodiment, the Sheffield smoothness of surface 47 is less than about 30, and more preferably less than about 20, and even more preferably less than about 10. In one aspect of this embodiment, the Sheffiield smoothness of surface 47 is preferably less than about 5.

Referring again to FIG. 1, and to the preferred embodiment depicted therein, it will be seen that cleaning film 100 preferably has a thickness 43 of less than about 500 microns. In one embodiment, thickness 43 is from about 25 microns to about 400 microns. In another embodiment, thickness 43 is from about 50 to about 200 microns. In another embodiment, thickness 43 is from about 100 to about 175 microns. The thickness 43 is preferably measured from the bottom of surface 45 to the top of surface 47; to the extent that the soft particles 103 extend above the matrix in which they are embedded, these soft particles 103 represent the top of surface 47.

Referring again to FIG. 1, and to the preferred embodiment depicted therein, it should be noted that conventional print head cleaning cards of the prior art are comprised of rough abrasive substrates in which hard particles extend from the surface of the substrate and are strongly anchored to the substrate. When such cleaning cards are placed in a thermal printing nip 49 and pulled across the array 52 of said nip, the cleaning card is able to scratch both contamination off of the array 52 as well as the top surfaces of the print head 54 itself.

This invention provides, in one embodiment thereof, a means for the regular maintenance of the print head with a non-abrasive cleaning film that will not damage the print head. In a preferred embodiment of this invention, the non-abrasive cleaning film is attached to the thermal media so that it is conveniently used each time the media is changed. Such regular maintenance helps to minimize the heavy contamination that might otherwise build-up on the print head and degrade its performance.

Non-abrasive cleaning films are an alternative to aggressive lapping films, which are typically used to clean thermal print heads and subsequently reduce their usable life. While these non-abrasive films are not able to completely restore a badly contaminated print head, neither does their use damage the print head. These cleaning cards, however, provide no cleaning of the print platen or roll which may also be contributing to the poor printer performance, and the user must employ a separate means to remove any debris accumulating on these surfaces.

Figure 2:
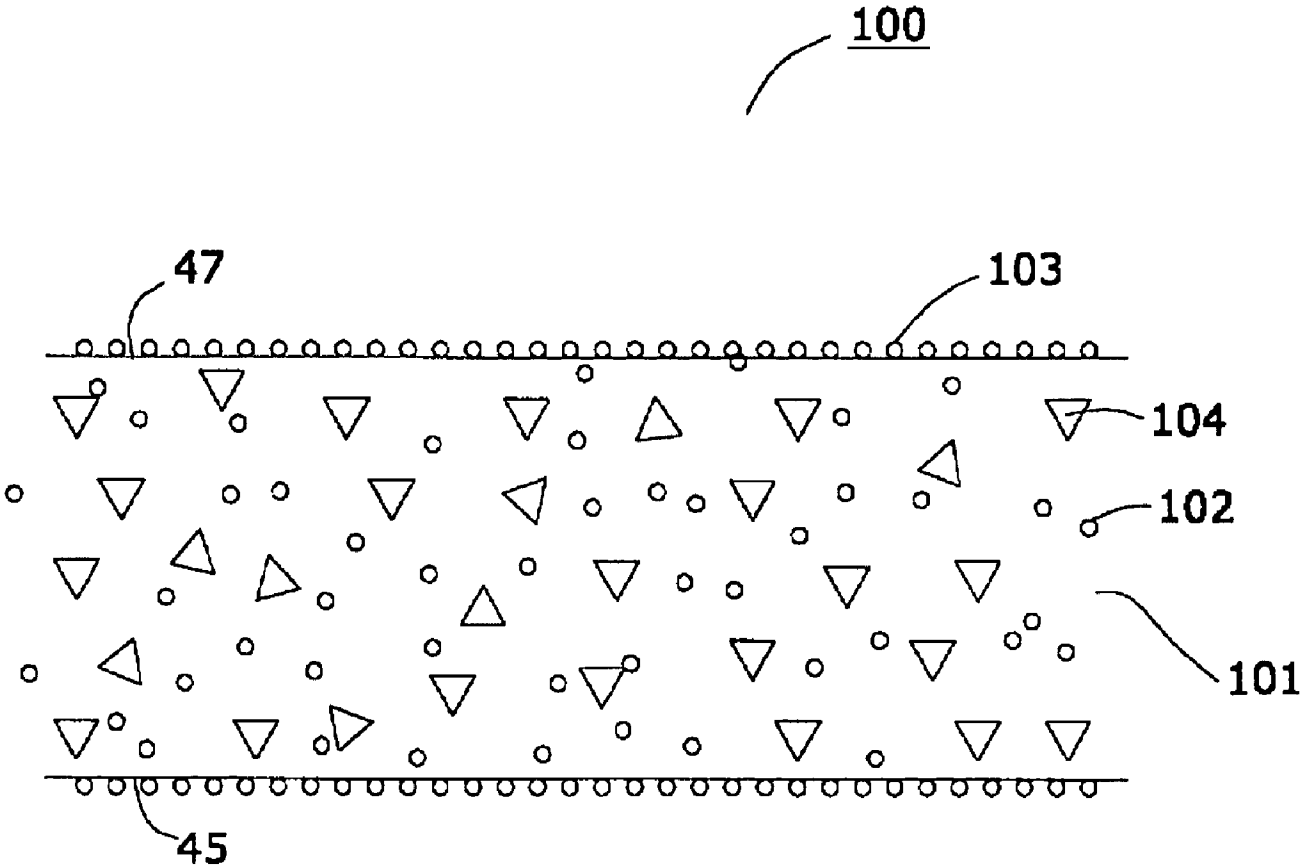
FIG. 2 is a schematic representation of a print head cleaning film.

FIG. 2 is a schematic representation of a preferred print head cleaning film 100. The cleaning film is comprised of a flexible support 101. The flexible support 101 may be comprised of films of plastic such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated resin, ionomer, or papers such as kraft, vellum, resin coated, condenser paper and paraffin paper, or other synthetic non-woven sheets, and/or laminates of these materials.

As will be apparent to those skilled in the art, the film 100 depicted in FIG. 2 may be prepared by conventional means of preparing a molten polymer mix comprised of particles 102, 103, and 104 homogeneously dispersed therein and then extruding the film 100 from such molten mix. Alternatively, or additionally, some of the particles (such as particles 103) may be embedded into the surfaces 45 and/or 47 of the film 100 after it has been extruded.

The product produced by such an extrusion process will have some particles 102, 103, and/or 104 disposed entirely within the film.

Regardless of what base material is used for flexible support 101, such base material is preferably comprised of a multiplicity of soft cleaning particles 102 intimately and homogeneously dispersed therein. As is apparent to those skilled in the art, one may make a structure such as cleaning film 100 by forming a polymer melt comprised of polymer and soft particles 102 and/or opacification particles 104 and thereafter extruding a thin film from such polymer melt by conventional means.

In one embodiment, some of the soft cleaning particles 103 are loosely held onto the surface of the flexible substrate 101. As used herein, the term loosely held means that at least some of such particles 103 are adapted to be dislodged from the surface 47 by the application of the shear stress typically encountered as the film 100 is compressed within nip 49 and translated past print head 54.

These soft cleaning particles 103 may be any inorganic particle with a hardness below Knoop 800. Thus, by way of illustration and not limitation, one may use inorganic particles such as calcium carbonate particles, mica particles, talc particles, clay particles, and the like.

Alternatively, or additionally, the soft cleaning particles 103 may be comprised of or consist of organic particles such as polystyrene, polymethylmethacrylate, poly(n-butyl acrylate), polybutadiene, poly(divinylbenzene), cellulose acetate and the like, provided that such particles have the Knoop hardness values described and that the film surfaces of which they are comprised have the Sheffield smoothness values described hereinabove. Particles comprised of blends of one or more organic and inorganic materials may also be utilized.

Referring again to FIG. 2, the flexible substrate 101 may be further comprised of opacification particles 104. Such opacification particles particles help to reduce light transmission through the flexible film 100 and give the film 100 a white appearance. Such opacification particles 104 typically have a refractive index above 1.4. Examples of such particles include titanium dioxide, barium oxide and the like.

Referring again to FIG. 2, non-abrasive cleaning films 100 may optionally be comprised of clay or calcium carbonated treated synthetic papers. Thus, by of illustration and not limitation, one may use one or more of the synthetic papers sold by the Hop Industries Corporation of 174 Passaic Street, Garfield, N.J. Thus, e.g., one may use HOP 5.9 microns synthetic paper. Thus, e.g., one may use "HOP-SYN Synthetic Paper," DLI grade; this paper is a clay modified polypropylene, and is a calendared plastic sheet made from a mixture of clay, calcium carbonate and polypropylene resin.

By of further illustration, one may use one or more of the synthetic papers available (as oriented polypropylene and polyethylene based synthetic papers) as "Yupo synthetic paper" from Oji-Yuka Synthetic Paper Co. of Tokyo, Japan. One may use the "Polyart synthetic paper" obtainable from Arjobex of Paris, France. One may use the "Kimdura synthetic paper" sold by the Avery Dennison company of Pasadena, Calif. These and other synthetic papers are well known and are disclosed, e.g., in U.S. Pat. Nos. 5,474,966; 6,086,987; and 5,108,834 and in U.S. patent application 2003/0089450; the entire disclosure of each of these patent documents is hereby incorporated by reference into this specification. Preferably such synthetic papers have a Sheffield Smoothness of less than about 100.

These smooth synthetic papers, when used in applicants' invention, provide mild cleaning print head build-up without scratching of the print head. Overall film thickness of the cleaning film 100 often influences performance, depending upon the thermal transfer printer being cleaned. The contact pressure between the print head and the cleaning film 100 will vary from printer to printer and will increase with the thickness of the cleaning film 100. It has been found that, in some embodiments, thicker cleaning films 100 improve the cleaning action without damaging the print head.

In one embodiment, the preferred smooth cleaning films 100 have a thickness of between about 25 and about 500 microns. More preferably, they have a thickness from 50 microns to 250 microns.

In one embodiment, the smooth cleaning films 100 have a Sheffield smoothness between 0.1 and 1000. More preferably, they have a smoothness between 0.1 and 50.

Figure 3:
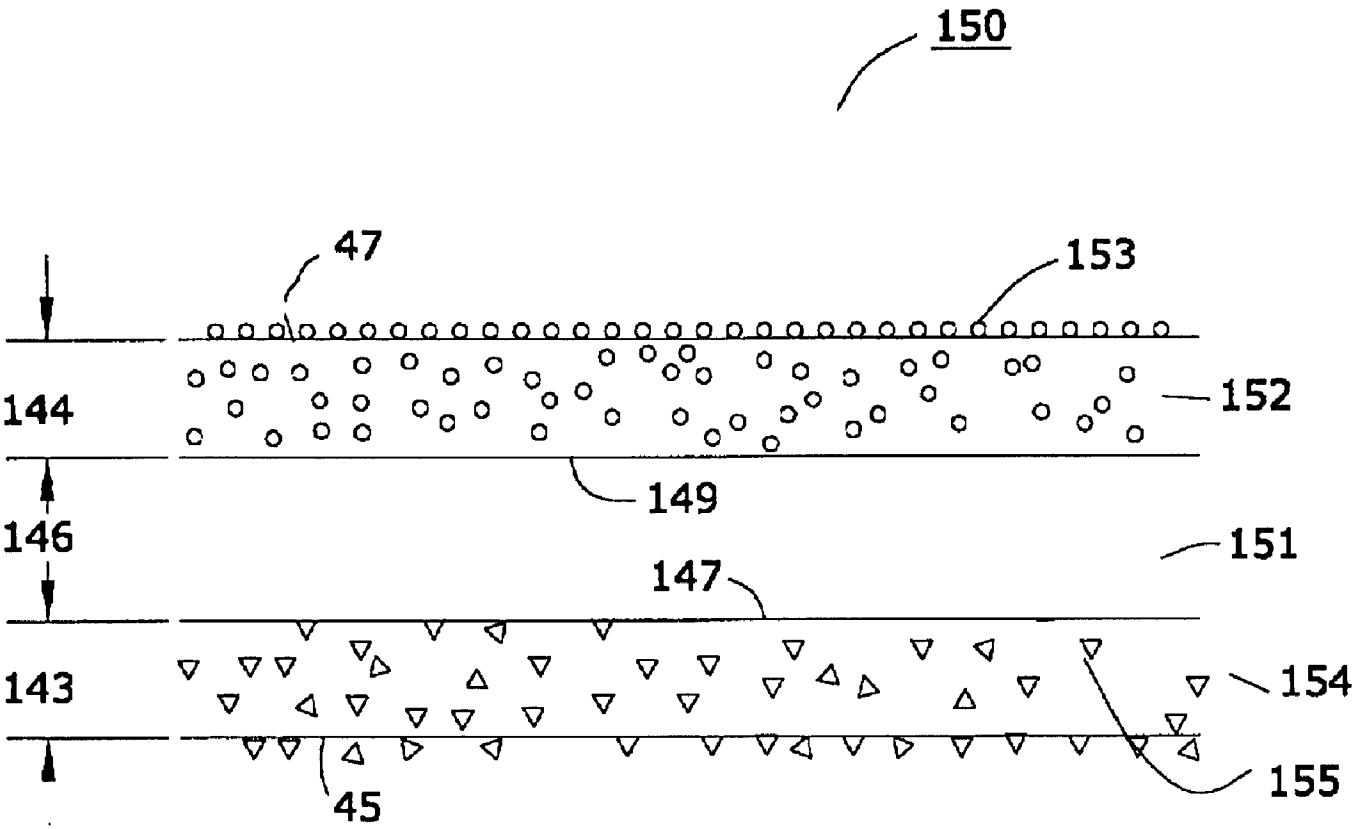
FIG. 3 is a schematic representation of a multi-layer print head cleaning film.

FIG. 3 depicts a multi-layer print head cleaning film 150. This print head cleaning film 150 is comprised of a flexible support 151 on either side of which coatings 152 and 154 are disposed. Such a structure can be prepared, e.g., by extruding a plastic film 151 and, thereafter, depositing coatings 152 and 154 on both sides of the plastic films 151.

Suitable flexible supports 151 may, e.g., be comprised of films of plastic such as poly(ethylene terephthalate), other polyesters, polyethylene, polypropylene, polyolefins, cellophane, polycarbonate, cellulose acetate, polyethylene, polyvinyl chloride, polystyrene, nylon, polyimide, polyvinylidene chloride, polyvinyl alcohol, fluororesin, chlorinated resin, ionomer, paper (such as condenser paper and paraffin paper), nonwoven fabric, and laminates of these materials. The thickness 146 of film 151 preferably is from about 25 to about 500 microns.

Referring again to FIG. 3, the multi-layer print head cleaning film is further comprised of a smooth, non-abrasive cleaning layer 152 disposed on side 149. The non-abrasive cleaning layer 152 is preferably comprised of soft particles 153, some of which are loosely bound to the surface of said cleaning layer 152. On the other side 147 of said support 151 is a second cleaning layer 154. The cleaning layer 154 is also preferably comprised of soft particles 155, some of which are loosely bound to the surface of said cleaning layer 154.

The soft particles 153 and 155, in one embodiment, differ from each other in either average particle size or composition; but they are both preferably within the range of properties described elsewhere in for soft particles 103. In addition, the smoothness of cleaning layer 152 preferably differs from cleaning layer 154.

Each of the layers 152 and 154 preferably has a thickness (144 and 143, respectively) of from about 1 to about 100 microns and, more preferably, from about 5 to about 25 microns. The thicknesses 144 and 143 may be the same, or they may differ.

Figure 4:
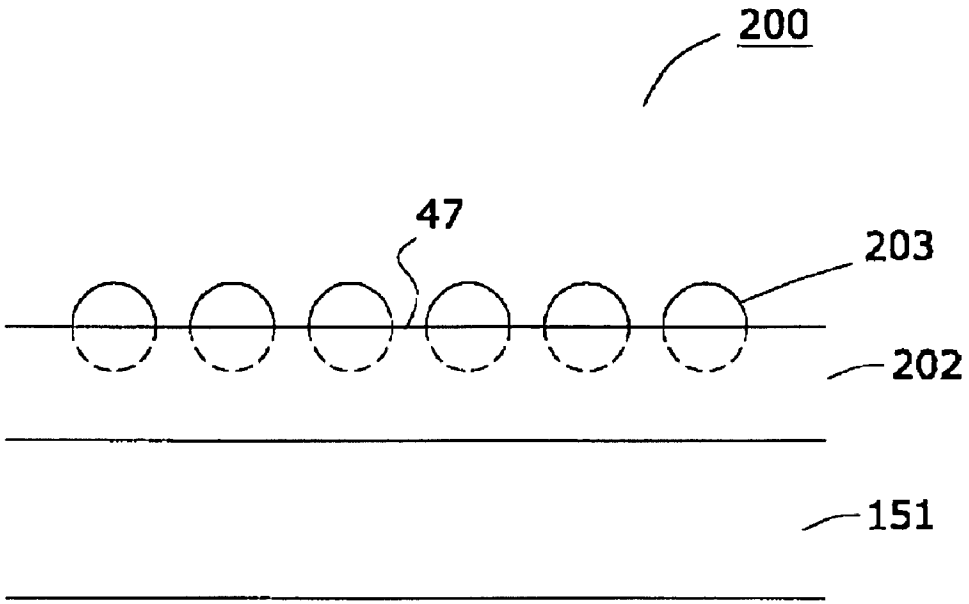
FIG.4 PRIOR ART
FIG. 4 is a schematic representation of a conventional print head cleaning card.

FIG. 4 is a schematic representation of a conventional, "prior art" print head cleaning card 200. This cleaning card 200 is comprised of a flexible substrate 151 (described elsewhere in this specification). Coated on at lease one surface of said flexible substrate 151 is an abrasive layer 202. This abrasive layer is comprised of hard particles 203 anchored into the layer 202. The hard particles 203 may be comprised of alumina, crushed alumina, calcined alumina and silicon carbide, silica, diamond, garnet and other similar inorganic, mineral or metallic particles. These particles generally have a Knoop hardness greater than about 800. In one embodiment, the opposite side of the card is not coated or coated with the same abrasive layer as the first side.

Referring to FIG. 4, it will be seen that surface 47 is comprised of a multiplicity of hard particles 203 and often has a Sheffield smoothness of greater than about 80. Some of the more aggressive cleaning cards often have a Sheffield smoothness on surface 47 of at least about 100.

Referring again to FIG. 4, it will be seen that the abrasive layer 202 is further comprised of a binder. This binder provides high adhesion to the flexible substrate 151. In addition, the binder must strongly bond the hard particles 203 such that when the cleaning card is pulled across the print head, the particles are able to scratch the surface of the print head and any associated contamination without easily breaking free.

Figure 5:
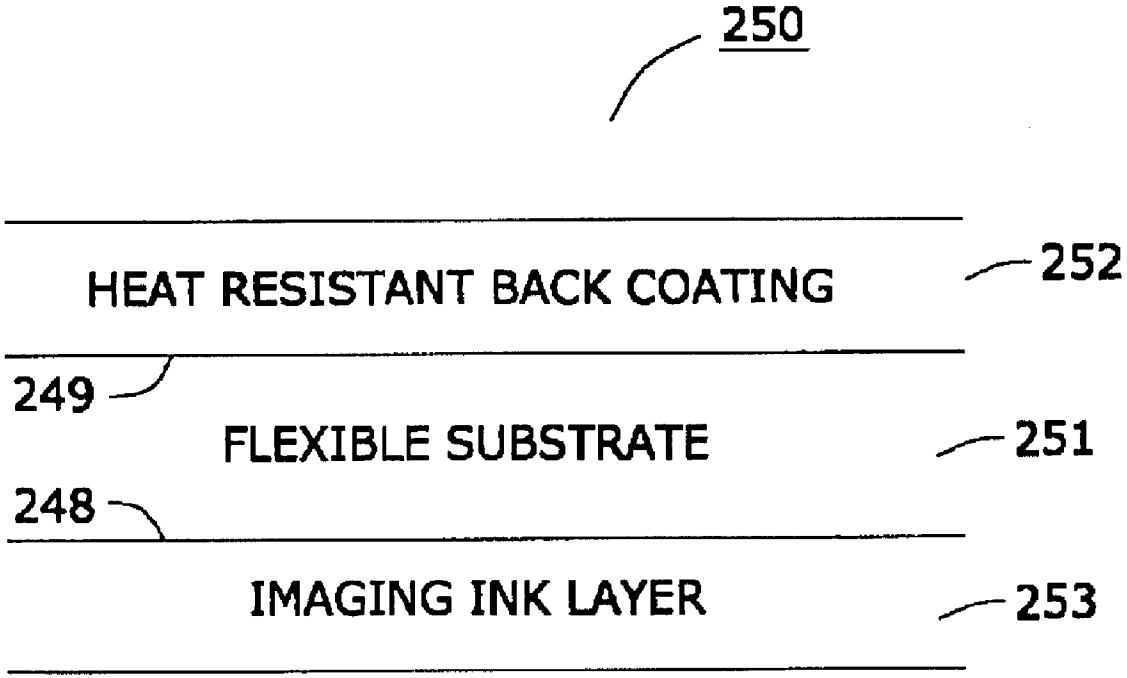
FIG. 5 is a schematic representation of a thermal transfer ribbon.

FIG. 5 depicts the cross sectional structure of a thermal transfer ribbon 250, which is one embodiment of the thermally sensitive media described elsewhere in this specification. In the embodiment depicted, the ribbon 250 is comprised of a flexible substrate 251 with a heat resistant back-coating 252 on back side and an imaging ink layer 253 on the face side 248. The back-coating 252 is designed to come in direct contact with the print head 54 and to facilitate the smooth transport of the ribbon across the print head. To do this, the back-coat 252 should prevent the flexible substrate from sticking to the print head, even at very high temperatures. The back-coat 252 should also control the friction of the flexible substrate as it is transported across the print head. In order to minimize wrinkling of the ribbon 250, this friction should not vary significantly with temperature because there may be a wide distribution of temperatures across the elements of the print head, depending upon the image being printed.

The ribbon substrate 251 may be any substrate typically used in thermal transfer ribbons such as, e.g., the substrates described in U.S. Pat. No. 5,776,280; the entire disclosure of this patent is hereby incorporated by reference into this specification.

In one embodiment, flexible substrate 251 is a material that comprises a smooth, tissue-type paper such as, e.g., 30–40 gauge capacitor tissue. In another embodiment, the flexible substrate 251 is a material consisting essentially of synthetic polymeric material, such as poly(ethylene terephthalate) polyester with a thickness of from about 1.5 to about 15 microns which, preferably, is biaxially oriented. Thus, by way of illustration and not limitation, one may use polyester film supplied by the Toray Plastics of America (of 50 Belvere Avenue, North Kingstown, R.I.) as catalog number F53.

By way of further illustration, flexible substrate 251 may be any of the substrate films disclosed in U.S. Pat. No. 5,665,472, the entire disclosure of which is hereby incorporated by reference into this specification. Thus, e.g., one may use films of plastic such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated resin, ionomer, paper such as condenser paper and paraffin paper, nonwoven fabric, and laminates of these materials.

Referring again to FIG. 5, and in the preferred embodiment depicted therein, affixed to the back surface 249 of the ribbon substrate 251 is the back-coating 252, which is similar in function to the "backside layer" described at columns 2–3 of U.S. Pat. No. 5,665,472.

The back-coating 252 and other layers, which form a thermal transfer ribbon, may be applied by conventional coating means. Thus, by way of illustration and not limitation, one may use one or more of the coating processes described in U.S. Pat. No. 6,071,585 (spray coating, roller coating, gravure, or application with a kiss roll, air knife, or doctor blade, such as a Meyer rod); U.S. Pat. No. 5,981,058 (Meyer rod coating); U.S. Pat. Nos. 5,997,227; 5,965,244; 5,891,294; 5,716,717; 5,672,428; 5,573,693; 4,304,700; and the like. The entire disclosure of each of these United States patents is hereby incorporated by reference into this specification.

Thus, e.g., the back-coating 252 may be formed by dissolving or dispersing in a binder resin containing additive such additives as a slip agent, surfactant, inorganic particles, organic particles, etc. also with a suitable solvent to prepare a coating liquid. Coating the coating liquid by means of conventional coating devices (such as Gravure coater or a wire bar) may then occur, after which the coating may be dried.

Binder resins usable in the back-coating include, e.g., cellulosic resins such as ethyl cellulose, hydroxyethylcellulose, hydroxypropylcellulose, methylcellulose, cellulose acetate, cellulose acetate butyrate, and nitrocellulose. Vinyl resins, such as polyvinylalcohol, polyvinylacetate, polyvinylbutyral, polyvinylacetal, and polyvinylpyrrolidone, also may be used. One also may use acrylic resins such as polyacrylamide, polyacrylonitrile-co-styrene, polymethylmethacrylate, and the like. One may also use polyester resins, silicone-modified or fluorine-modified urethane resins, and the like.

In one embodiment, the binder comprises a cross-linked resin. In this case, a resin having several reactive groups, for example, hydroxyl groups, is used in combination with a crosslinking agent, such as a polyisocyanate.

In one embodiment, a back-coating 252 is prepared and applied at a coat weight of 0.05 grams per square meter. This back-coat preferably is a polydimethylsiloxane-urethane copolymer sold as ASP-2200@ by the Advanced Polymer Company of New Jersey.

One may apply back-coating 252 at a coating weight of from about 0.01 to about 2 grams per square meter, with a range of from about 0.02 to about 0.4 grams/square meter being preferred in one embodiment and a range of from about 0.5 to about 1.5 grams per square meter being preferred in another embodiment.

Referring again to FIG. 5, and in the embodiment depicted therein, affixed to the face side 248 of ribbon substrate 251 is the imaging ink layer 253. The imaging ink layer is preferably comprised of one or more imaging colorants and one or more binder materials. The imaging ink layer 253 must be able to be selectively transferred from the thermal transfer ribbon 250 to a receiving sheet upon action from the thermal print head of the digital printer. This action is the selective generation of heat at specific points on the print head where transfer of the image layer is desired. This heat generation causes the imaging ink layer 253 to soften or melt in areas directly below the heated imaging elements of the print head. Once these areas of the imaging ink layer 253 are softened or melted, they may wet and adhere to the receiving sheet in which they are in direct contact. After this heating step, the ribbon 250 and associated receiving sheets are indexed away from the print head and the ribbon 250 is separated from the receiving sheet. Imaging layer ink 253, which had been softened or melted by the action of the print head, will stay with the receiving sheet after separation of the ribbon 250. Imaging layer ink 253, which had not been softened or melted by action of the print head, will stay with the ribbon 250.

Referring again to FIG. 5, the imaging ink layer 253 is preferably comprised of colorants which enable the layer to have contrast so that the transition between printed and unprinted areas can be easily detected either by the human eye or by some other means of detection such as a scanner, a CCD, a photoelectric cell, a photo-multiplier cell and the like. The contrast provided by the imaging layer colorants is preferably in the visible region of the electromagnetic spectrum. However, it may also be in the infrared or ultraviolet regions. The contrast provided by the imaging layer colorants may be a result of absorption, reflection or florescence of the electromagnetic radiation used to illuminate the image. Suitable imaging layer colorants may be dyes, organic pigments, inorganic pigments, metals, florescent agents, opacification agents and the like.

A preferred imaging layer colorant is carbon black pigment.

Preferred opacification agents are insoluble in the imaging ink layer 253 and have a refractive index which differs by at least 0.1 from the remainder of the imaging ink layer.

In a preferred embodiment, the imaging ink layer is comprised of from about 0.1 to about 75 percent imaging colorant.

Referring again to FIG. 5, the imaging ink layer 253 is further comprised of one or more binder materials in a concentration of from about 0 to about 75 percent, based upon the dry weight of frit and binder in such layer 253. In one embodiment, the binder is present in a concentration of from about 15 to about 35 percent. In another embodiment, the layer 253 is comprised of from about 15 to about 75 weight percent of binder.

One may use any of the thermal transfer binders known to those skilled in the art. Thus, e.g., one may use one or more of the thermal transfer binders disclosed in U.S. Pat. Nos. 6,127,316; 6,124,239; 6,114,088; 6,113,725; 6,083,610; 6,031,556; 6,031,021; 6,013,409; 6,008,157; 5,985,076; and the like. The entire disclosure of each of these United States patents is hereby incorporated by reference into this specification.

By way of further illustration, one may use a binder which preferably has a softening point from about 45 to about 150 degrees Celsius and a multiplicity of polar moieties such as, e.g., carboxyl groups, hydroxyl groups, chloride groups, carboxylic acid groups, urethane groups, amide groups, amine groups, urea, epoxy resins, and the like. Some suitable binders within this class of binders include polyester resins, bisphenol-A polyesters, polyinyl chloride, copolymers made from terephthalic acid, polymethyl methacrylate, vinyl chloride/vinyl acetate resins, epoxy resins, nylon resins, urethane-formaldehyde resins, polyurethane, mixtures thereof, and the like.

In one embodiment a mixture of two synthetic resins is used. Thus, e.g., one may use a mixture comprising from about 40 to about 60 weight percent of polymethyl. methacrylate and from about 40 to about 60 weight percent of vinylchloride/vinylacetate resin. In this embodiment, these materials collectively comprise the binder.

In one embodiment, the binder is comprised of polybutylmethacrylate and polymethylmethacrylate, comprising from 10 to 30 percent of polybutylmethacrylate and from 50 to 80 percent of the polymethylacrylate. In one embodiment, this binder also is comprised of cellulose acetate propionate, ethylenevinylacetate, vinyl chloride/vinyl acetate, urethanes, etc.

One may obtain these binders from many different commercial sources. Thus, e.g., some of them may be purchased from Dianal America of 9675 Bayport Blvd., Pasadena, Tex. 77507; suitable binders available from this source include "Dianal BR 113" and "Dianal BR 106." Similarly, suitable binders may also be obtained from the Eastman Chemicals Company (Tennessee Eastman Division, Box 511, Kingsport, Tenn.).

Referring again to FIG. 5, in addition to the imaging colorant and the binder, the layer 253 may optionally contain from about 0 to about 99 weight of wax and, preferably, 5 to about 75 percent of such wax. In one embodiment, layer 253 is comprised of from about 5 to about 10 weight percent of such wax. Suitable waxes which maybe used include carnuaba wax, rice wax, beeswax, candelilla wax, montan wax, paraffin wax, microcrystalline waxes, synthetic waxes such as oxidized wax, ester wax, low molecular weight polyethylene wax, Fischer Tropsch wax, and the like. These and other waxes are well known to those skilled in the art and are described, e.g., in U.S. Pat. No. 5,776,280. One may also use ethoxylated high molecular weight alcohols, long chain high molecular weight linear alcohols, copolymers of alpha olefin and maleic anhydride, polyethylene, polypropylene, These and other suitable waxes are commercially available from, e.g., the BakerHughes Baker Petrolite Company of 12645 West Airport Blvd., Sugarland, Tex.

In one preferred embodiment, carnuaba wax is used as the wax. As is known to those skilled in the art, carnuaba wax is a hard, high-melting lustrous wax which is composed largely of ceryl palmitate; see, e.g., pages 151–152 of George S. Brady et al.'s "Material's Handbook," Thirteenth Edition (McGraw-Hill Inc., New York, N.Y., 1991). Reference also may be had, e.g., to U.S. Pat. Nos. 6,024,950; 5,891,476; 5,665,462; 5,569,347; 5,536,627; 5,389,129; 4,873,078; 4,536,218; 4,497,851; 4,4610,490; and the like. The entire disclosure of each of these United States patents is hereby incorporated by reference into this specification.

Layer 253 may also be comprised of from about 0 to 16 weight percent of plasticizers adapted to plasticize the resin used. Those skilled in the art are aware of which plasticizers are suitable for softening any particular resin. In one embodiment, there is used from about 1 to about 15 weight percent, by dry weight, of a plasticizing agent. Thus, by way of illustration and not limitation, one may use one or more of the plasticizers disclosed in U.S. Pat. No. 5,776,280 including, e.g., adipic acid esters, phthalic acid esters, chlorinated biphenyls, citrates, epoxides, glycerols, glycol, hydrocarbons, chlorinated hydrocarbons, phosphates, esters of phthalic acid such as, e.g., di-2-ethylhexylphthalate, phthalic acid esters, polyethylene glycols, esters of citric acid, epoxides, adipic acid esters, and the like.

In one embodiment, layer 253 is comprised of from about 6 to about 12 weight percent of the plasticizer, which in one embodiment, is dioctyl phthalate. The use of this plasticizing agent is well known and is described, e.g., in U.S. Pat. Nos. 6,121,356; 6,117,572; 6,086,700; 6,060,234; 6,051,171; 6,051,097; 6,045,646; and the like. The entire disclosure of each of these United States patent applications is hereby incorporated by reference into this specification. Suitable plasticizers may be obtained from, e.g., the Eastman Chemical Company.

Figure 6:
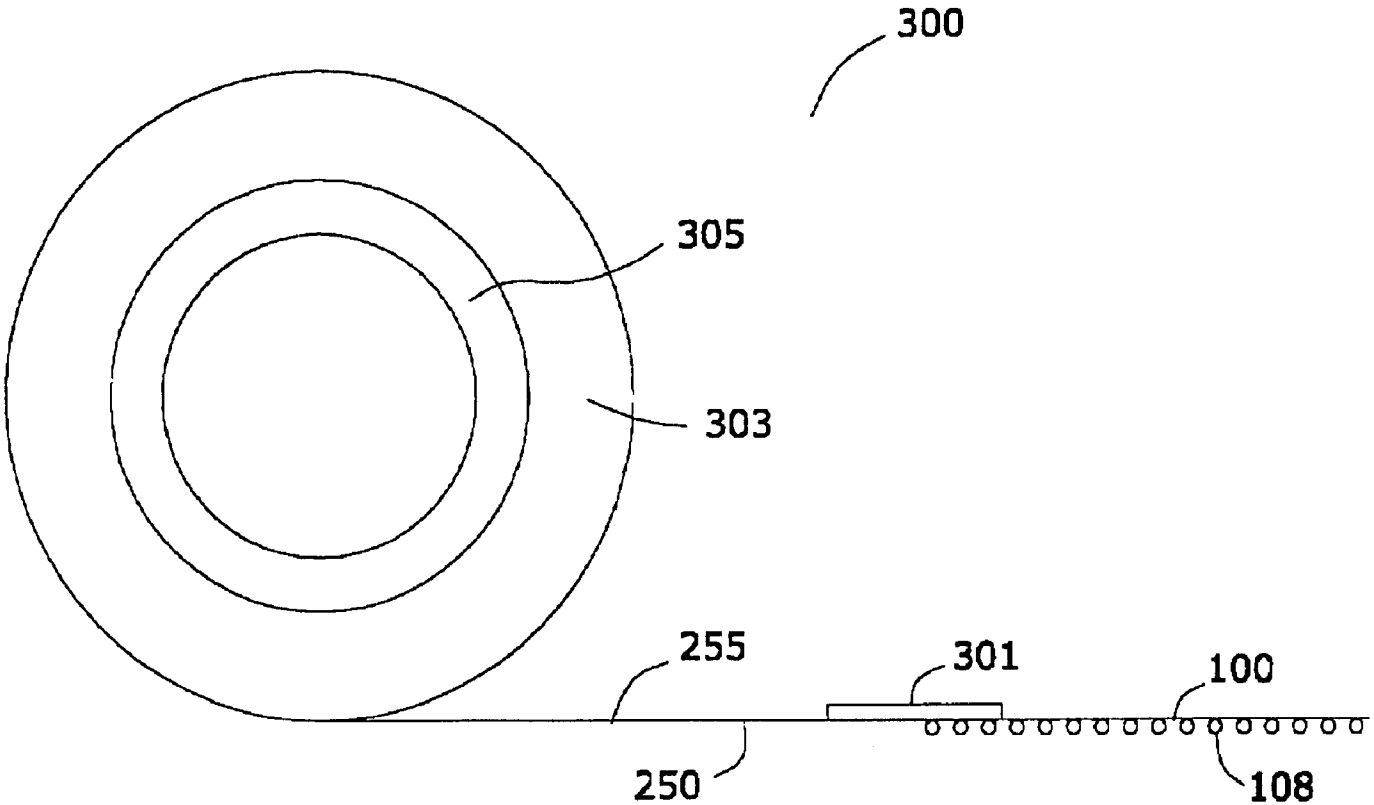
FIG. 6 is a schematic representation of a thermal transfer ribbon with a print head cleaning leader section with the imaging side of the ribbon coated on the inside of the roll.

FIG. 6 is a cross sectional representation of a thermal transfer ribbon composite 300. Thermal transfer ribbon composite 300 is comprised of a core 305 with a thermal transfer ribbon roll 303 wound upon it. The back coat side 250 of the thermal transfer ribbon 255 is wound on the outside of the ribbon roll 303. Attached to the beginning of the ribbon 255 is a print head cleaning leader 100. Said leader 100 is preferably attached to said ribbon 255 with splicing tape 301. The cleaning side 108 of the print head cleaning leader 100 is the same side as the back coat side 250 of the thermal transfer ribbon 255. The imaging side of the thermal transfer ribbon 255 is wound on the inside of the roll 303. It will be apparent to one skilled in the art that the opposite winding configuration is also commonly used. In this configuration the image side of the ribbon 255 is wound on the outside of the roll 303 and the back coat side 250 and cleaning side 108 of the leader are positioned on the inside of the roll 303.

Figure 7:
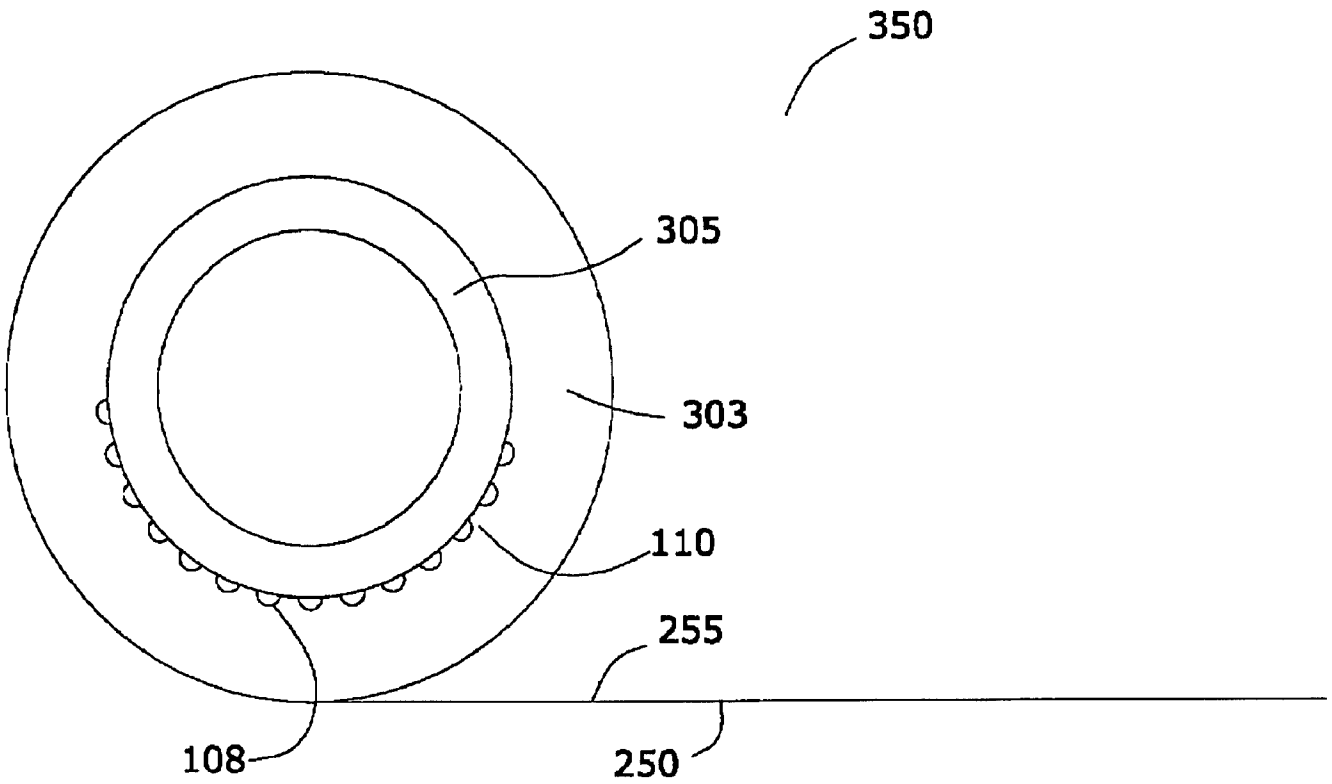
FIG. 7 is a schematic representation of a thermal transfer ribbon with a print head cleaning trailer section.

FIG. 7 is a cross sectional representation of a thermal transfer ribbon composite 350. Thermal transfer ribbon composite 350 is comprised of a core 305 with a thermal transfer ribbon roll 303 wound upon it. The back coat side 250 of the thermal transfer ribbon 255 is wound on the outside of the ribbon roll 303. Attached to the end of the ribbon 255 is a print head cleaning trailer 110. Said trailer 110 is also preferably attached to said core 305 with splicing tape. The cleaning side 108 of the print head cleaning trailer 110 is congruent with and the same side as the back coat side 250 of the thermal transfer ribbon 255. The imaging side of the thermal transfer ribbon 255 is wound on the outside of the roll 303.

Figure 8:
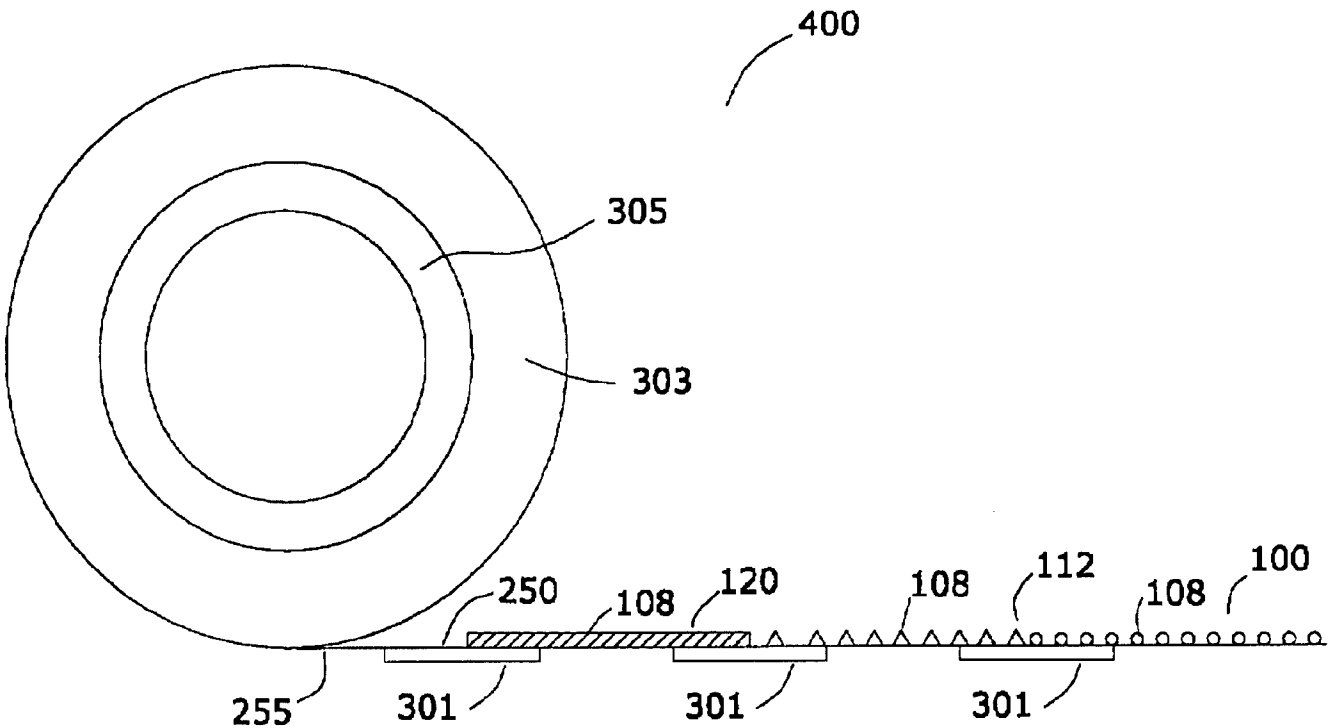
FIG. 8 is a schematic representation of a thermal transfer ribbon with multiple print head cleaning leader sections with the imaging side of the ribbon coated on the outside of the roll.

FIG. 8 is a cross sectional representation of a thermal transfer ribbon composite 400. Thermal transfer ribbon composite 400 is comprised of a core 305 with a thermal transfer ribbon roll 303 wound upon it. The back coat side 250 of the thermal transfer ribbon 255 is wound on the inside of the ribbon roll 303. Attached to the beginning of the ribbon 255 are three print head cleaning leader sections, 100, 112 and 120. Said leader sections 100, 112 and 120 are preferably attached to the ribbon 255 with splicing tape 301. The cleaning side 108 of the print head cleaning leader sections 100, 112 and 120 are on the same side as the back coat side 250 of the thermal transfer ribbon 255. The imaging side of the thermal transfer ribbon 255 is wound on the outside of the roll 303.

Figure 9:
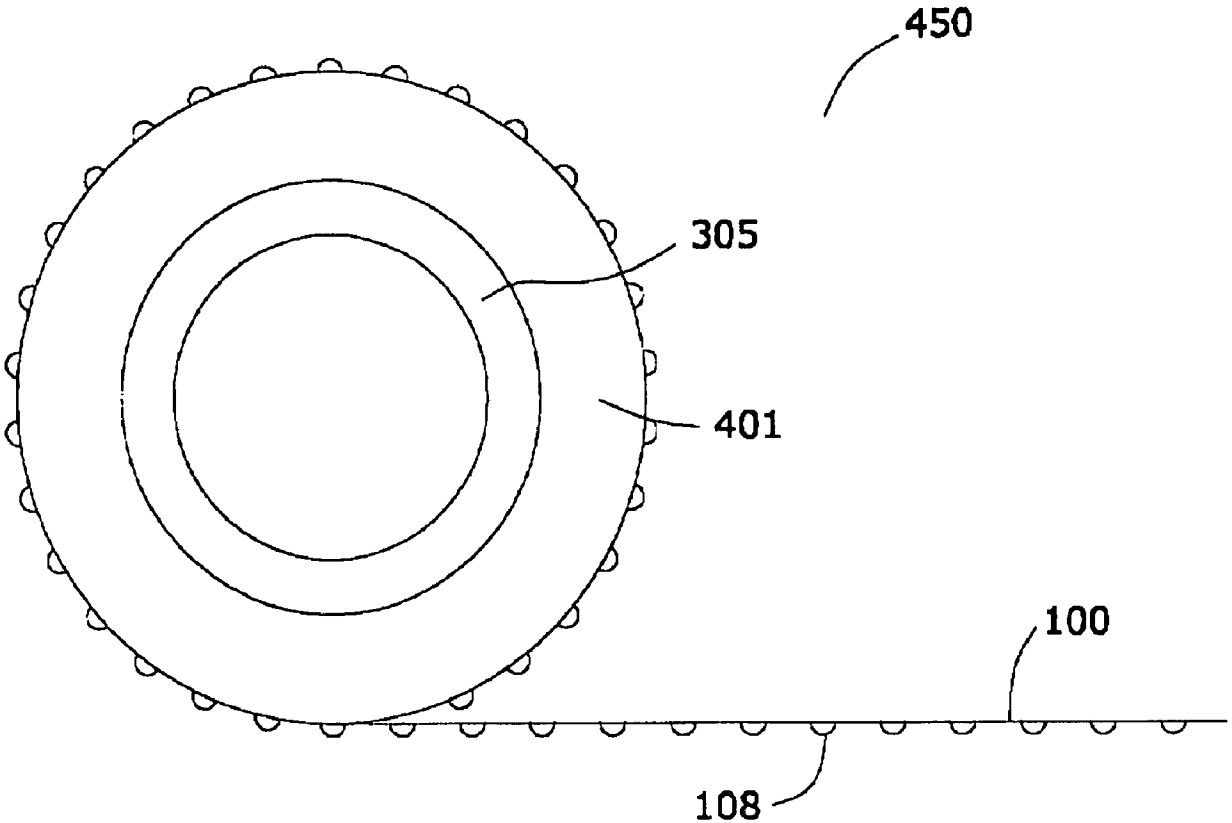
FIG. 9 is a schematic representation of a thermal transfer print head cleaning ribbon.

FIG. 9 is a cross sectional representation of a thermal transfer cleaning ribbon composite 450. Thermal transfer cleaning ribbon composite 450 is comprised of a core 305 with a thermal transfer cleaning roll 401 wound upon it. The cleaning side 108 of the thermal transfer cleaning ribbon 100 is wound on the outside of the ribbon roll 401. It will be apparent to one skilled in the art that the opposite winding configuration is also commonly used. In this configuration the cleaning side 108 of the ribbon 100 is wound on the inside of the roll 401.

Figure 10:
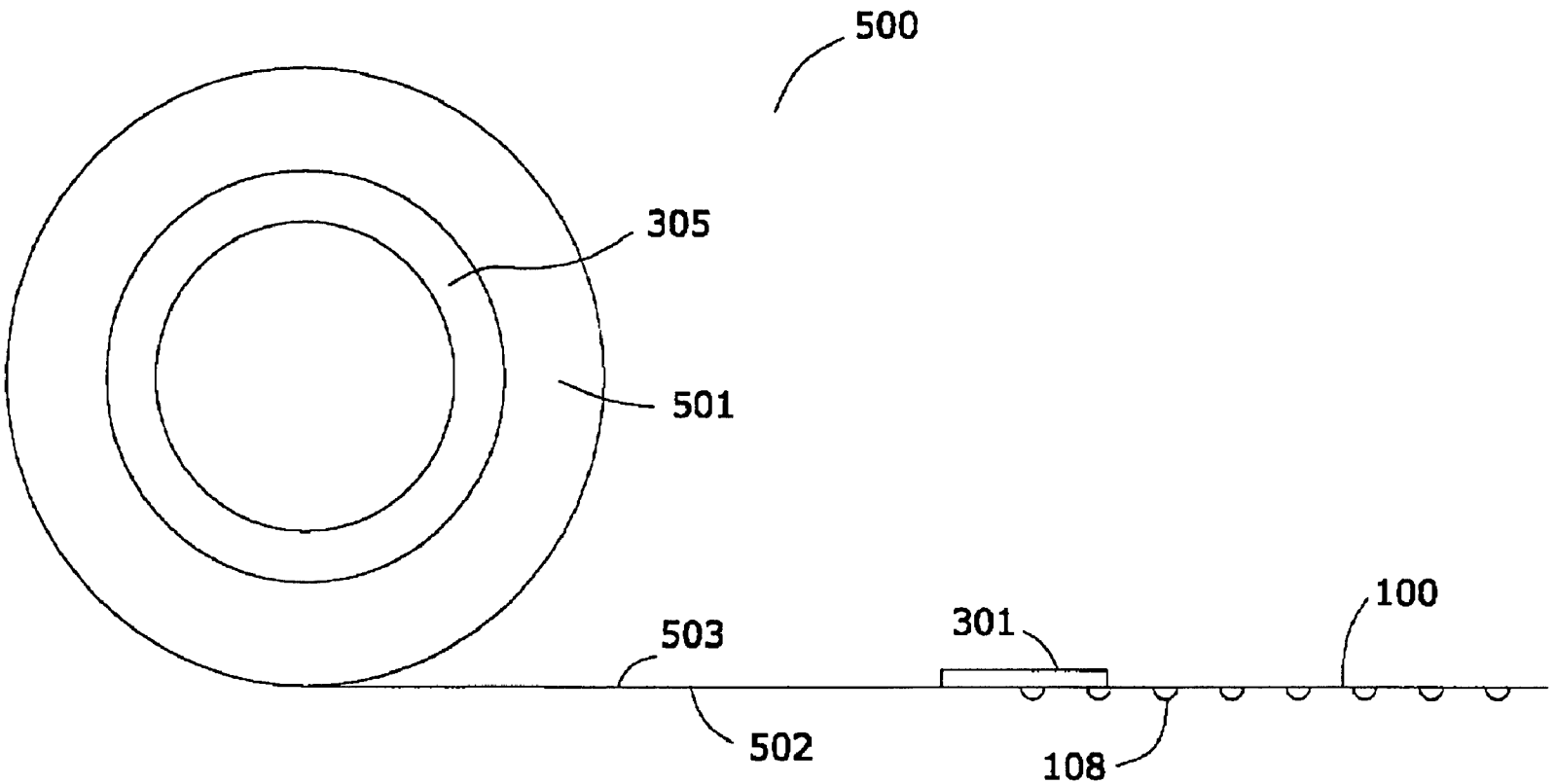
FIG. 10 is a schematic representation of a direct thermal imaging media spool with a print head cleaning leader section.

FIG. 10 is a schematic representation of a direct thermal imaging media composite 500. Direct thermal imaging composite 500 is comprised of a core 305 with a direct thermal media roll 501 wound upon it. The thermal sensitive imaging side 502 of the direct thermal media 503 is wound on the outside of the roll 501. Attached to the beginning of the media 503 is a print head cleaning leader 100. Said leader 100 is preferably attached to said media 503 with splicing tape 301. The cleaning side 108 of the print head cleaning leader 100 is congruent with and the same side as the imaging side 502 of the direct thermal media 503. It will be apparent to one skilled in the art that the opposite winding configuration is also commonly used. In this configuration the image side 502 of the media 503 is wound on the inside of the roll 501 along with the cleaning side 108 of the leader 100.

The use of applicants' cleaning film 100 with direct thermal media is within the scope of this invention. Such direct thermal media are described, e.g., in U.S. Pat. Nos. 4,287,264; 4,289,535; 4,675,705; 5,416,058; 5,537,140; 5,547,914; 5,582,953; 5,587,350; 6,090,747. The entire content of each of these patents is hereby incorporated by reference into this specification. The use of applicants' cleaning film 100 with dye sublimation media is within the scope of this invention.

Such dye sublimation ribbons are also called thermal dye transfer ribbons and such ribbons are described, e.g., in U.S. Pat. Nos. 6,619,869; 6,362,131; 6,195,111; 6,031,021; 6,010,259; 5,917,530; and 5,672,561. The entire content of each of these patents is hereby incorporated by reference into this specification.

Figure 11:
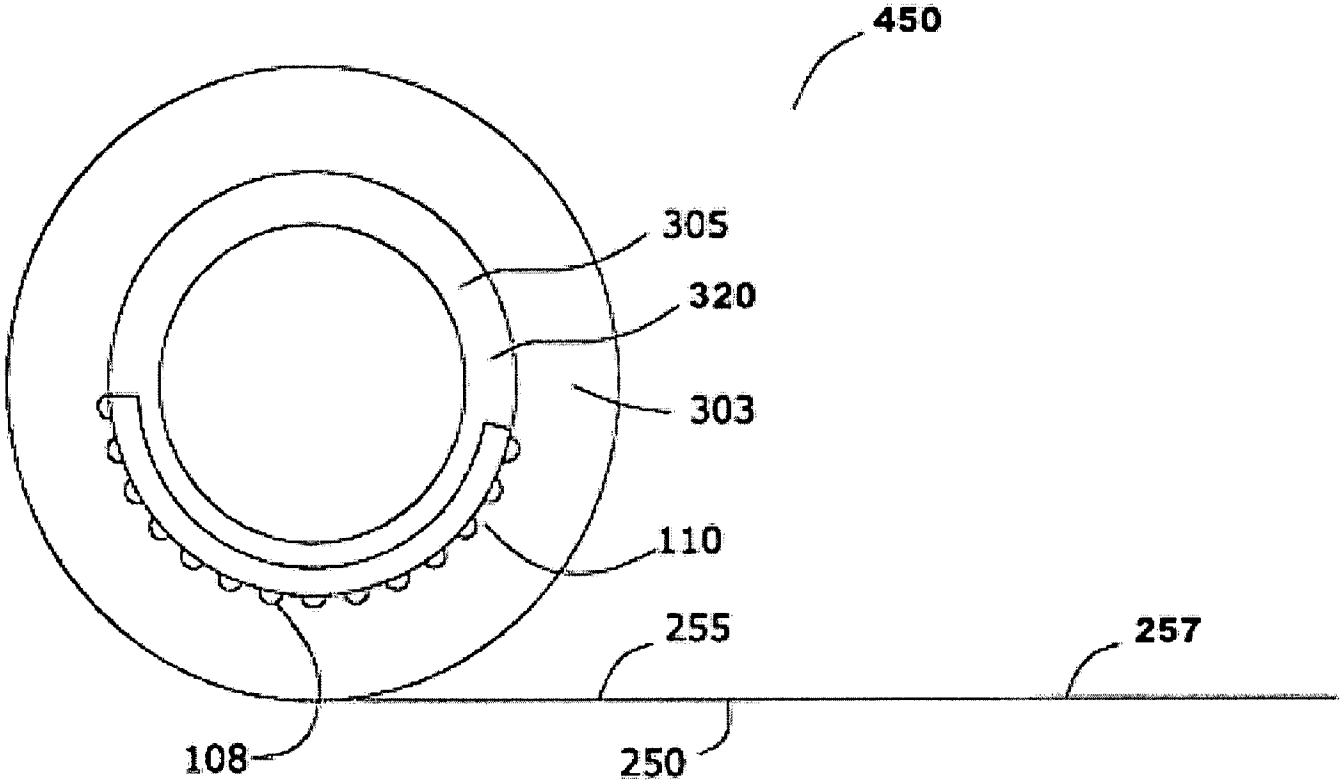
FIG. 11 is a schematic representation of a thermal transfer ribbon with a print head cleaning trailer section with an attached adhesive based printer platen roller cleaner section.

FIG. 11 is a cross sectional representation of a thermal transfer ribbon composite 450. Thermal transfer ribbon composite 450 is comprised of a core 305 with a thermal transfer ribbon roll 303 wound upon it. The back coat side 250 of the thermal transfer ribbon 255 is wound on the outside of the ribbon roll 303. Attached to the end of the ribbon 255 is a print head cleaning trailer 110. Said trailer 110 is also preferably attached to said core 305 with splicing tape. The cleaning side 108 of the print head cleaning trailer 110 is congruent with and the same side as the back coat side 250 of the thermal transfer ribbon 255. The imaging side of the thermal transfer ribbon 255 is wound on the outside of the roll 303. A platen roller cleaning adhesive 320 is coated on the backside of said print head cleaning trailer 110. The adhesive side 320 of the print head cleaning trailer 110 is congruent with and the same side as the imaging side 257 of thermal transfer ribbon 255.

In FIG. 11, the depicted embodiment is comprised of platen roller cleaning adhesive 320 that is coated on the backside of said print head cleaning trailer 110, opposite of surface 108 containing the above described particles. This adhesive is preferably one with low, but sufficient tack to remove particles and other debris from surfaces that come into contact with it, but prevent transfer of adhesive to such surfaces in contact. Adhesives such as PostItR™ (3M, Saint Paul, Minn.), Lamatek 2050RBA (Lamatek, Edgewater Park, N.J.), RadBond 12PSELV (RadCure), ValPak PS149 (ValPak, Federalsburg, Md.) or similar are applicable for this use.

Preferably a low tack or repositionable or removable pressure sensitive adhesive 322 like PostItR™ adhesive (available from 3M, Saint Paul Minn.) so that it has sufficient tack and shear strength to remove dirt and debris from the print roll or platen with sufficient adhesion to the film 151 such that no adhesive is transferred to either the cleaning side of film 151 or to the print roll or platen during the leaning operation. Examples of such adhesives are described in U.S. Pat. Nos. 3,691,140; 3,857,731; 3,924,043; 4,166,152; 4,495,318; 4,598,112; 4,645,783; 4,656,218; 4,786,696; 4,988,567; 4,994,322; 5,045,569; 5,118,750; 5,648,425; and 5,663,241. The entire content of each of these patents is hereby incorporated by reference into this specification.

The adhesive 320 can be added to the opposite side of the film in any conventional coating process such as gravure, reverse gravure, flow tube meyer rod, knife over roll, etc., chosen to match the molten or solution adhesive properties and the desired amount of coating deposition.

This invention provides, in one embodiment thereof, a means for the regular maintenance of the print head with a non-abrasive cleaning film that will not damage the print head and an adhesively coated opposite side to simultaneously remove debris from the backing roll or platen. In a preferred embodiment of this invention, the non-abrasive cleaning film is attached to the thermal media so that it is conveniently used each time the media is changed. When the film is pulled or driven through the printing nip, both the print head and the print platen or roller are cleaned simultaneously. Such regular maintenance helps to minimize the heavy contamination that might otherwise build-up on the print head and degrade its performance.

Non-abrasive cleaning films are an alternative to aggressive lapping films, which are typically used to clean thermal print heads and subsequently reduce their usable life. While these non-abrasive films are not able to completely restore a badly contaminated print head, neither does their use damage the print head. These cleaning cards, however, provide no cleaning of the print platen or roll which may also be contributing to the poor printer performance, and the user must employ a separate means to remove any debris accumulating on these surfaces.

Figure 12:
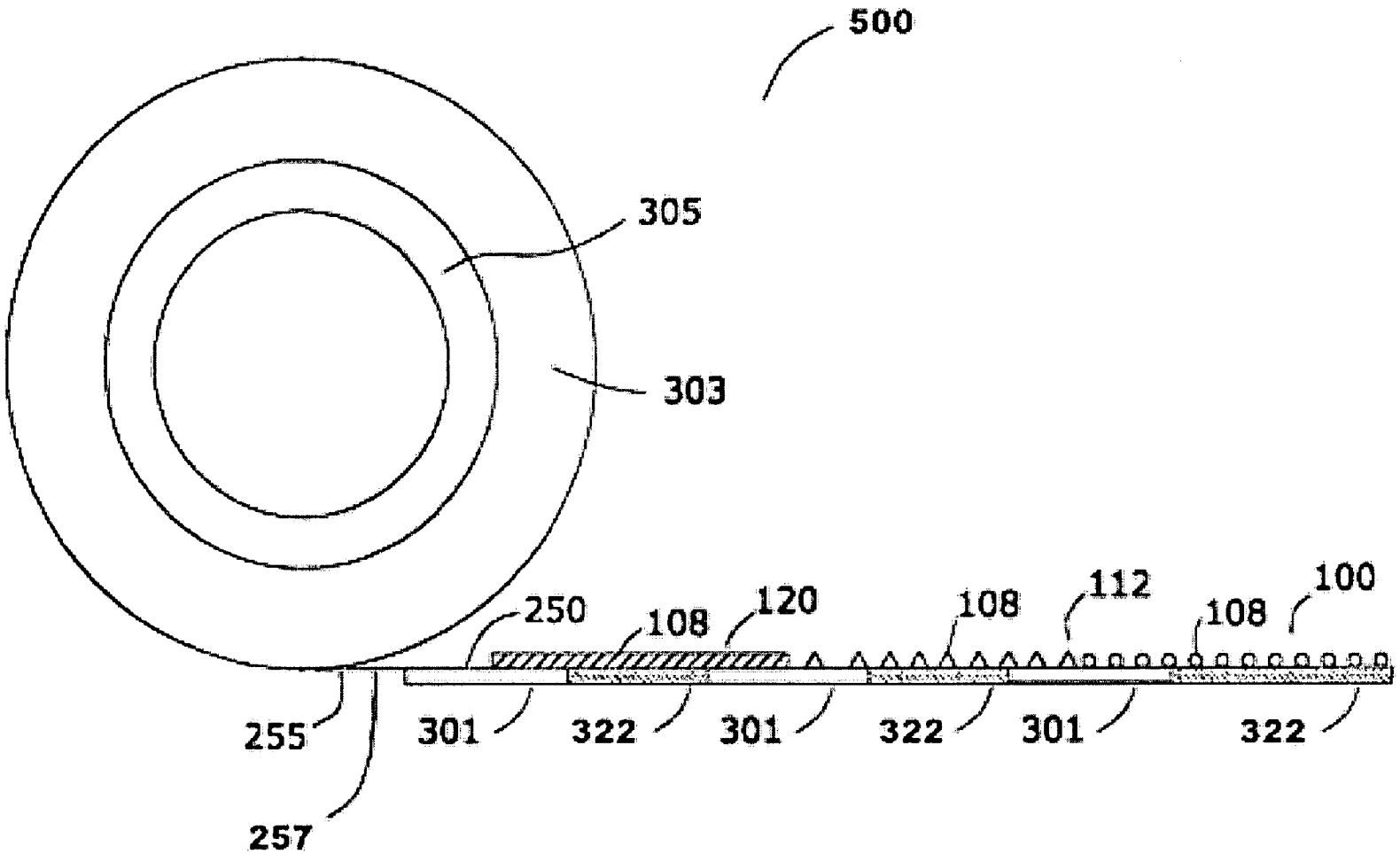
FIG. 12 is a schematic representation of a thermal transfer ribbon with multiple print head cleaning leader sections with the imaging side of the ribbon coated on the outside of the roll with an attached adhesive based printer platen roller cleaner section.

FIG. 12 is a cross sectional representation of a thermal transfer ribbon composite 500. Thermal transfer ribbon composite 500 is comprised of a core 305 with a thermal transfer ribbon roll 303 wound upon it. The back coat side 250 of the thermal transfer ribbon 255 is wound on the inside of the ribbon roll 303. Attached to the beginning of the ribbon 255 are three print head cleaning leader sections, 100, 112 and 120. Said leader sections 100, 112 and 120 are preferably attached to the ribbon 255 with splicing tape 301. The cleaning side 108 of the print head cleaning leader sections 100, 112 and 120 are on the same side as the back coat side 250 of the thermal transfer ribbon 255. The imaging side of the thermal transfer ribbon 255 is wound on the outside of the roll 303. A platen roller cleaning adhesive 322 is coated on the backside of said print head cleaning leader sections 100, 112 and 120. The adhesive side 322 of the print head cleaning leader sections 100, 112 and 120 are congruent with and the same side as the imaging side 257 of thermal transfer ribbon 255. It will be apparent to one skilled in the art that when the opposite side of the print head cleaning leader section 100, 112 or 120 has a platen cleaning adhesive 322 applied to it then simultaneous removal of dirt and debris from the platen roll or and print head can be accomplished.

Figure 13:
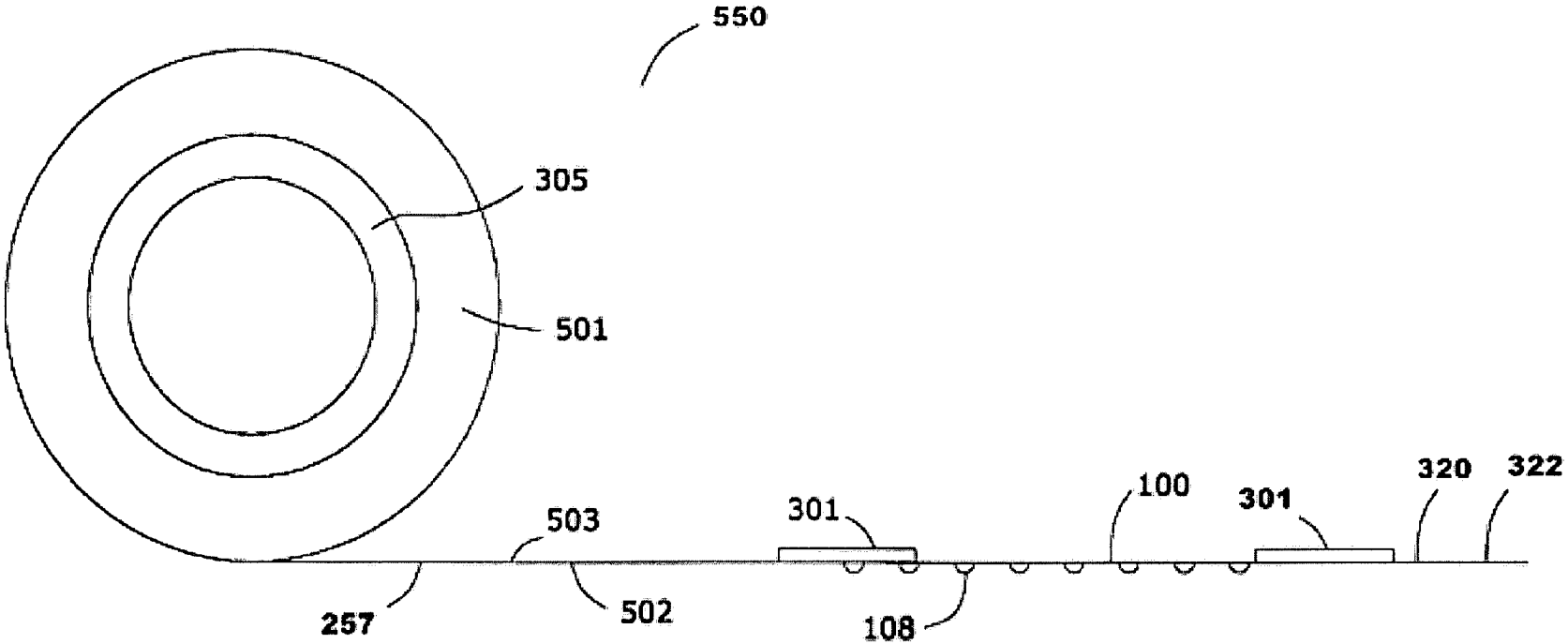
FIG. 13 is a schematic representation of a thermal transfer ribbon with the imaging side of the ribbon coated on the inside of the roll; a print head cleaning leader section congruent with the back side of the thermal transfer ribbon and an adhesive based printer platen roller cleaner section congruent with the imaging side of the thermal transfer ribbon.

FIG. 13 is a cross sectional representation of a thermal transfer ribbon composite 550. Thermal transfer ribbon composite 500 is comprised of a core 305 with a thermal transfer ribbon roll 303 wound upon it. The back coat side 250 of the thermal transfer ribbon 255 is wound on the outside of the ribbon roll 303. Attached to the beginning of the ribbon 255 is a print head cleaning leader 100. Said leader 100 is preferably attached to said ribbon 255 with splicing tape 301. The cleaning side 108 of the print head cleaning leader 100 is the same side as the back coat side 250 of the thermal transfer ribbon 255. The adhesive side of the print head cleaning leader 100 is the same side as the imaging side 253 of the thermal transfer ribbon 255. The imaging side of the thermal transfer ribbon 255 is wound on the inside of the roll 303. It will be apparent to one skilled in the art that the opposite winding configuration is also commonly used. In this configuration the image side of the ribbon 255 is wound on the outside of the roll 303 and the back coat side 250 and cleaning side 108 of the leader are positioned on the inside of the roll 303.

Attached to the beginning of said print head cleaning leader 100 is a platen cleaning leader 320. Said platen cleaning leader 320 is preferably attached to said print head cleaning leader 100 with splicing tape 301. The cleaning side 322 of the platen cleaning leader 320 is the same side as the imaging side 257 of the thermal transfer ribbon 255. The cleaning side 322 of said platen cleaning leader 320 is an adhesive coated on the platen cleaning leader 320 on the same side as the imaging side 257 of the thermal transfer ribbon 255. The cleaning adhesive 322 is low enough in tack such that it can be would into a thermal imaging composite roll 550 and subsequently be unwound for usage. The imaging side of the thermal transfer ribbon 255 is wound on the inside of the roll 303. It will be apparent to one skilled in the art that the opposite winding configuration is also commonly used. In this configuration the image side of the ribbon 255 is wound on the outside of the roll 303 and the back coat side 250 and cleaning side 108 of the leader are positioned on the inside of the roll 303.

EXAMPLES

The following examples are presented to illustrate the claimed invention but are not to be deemed limitative thereof. Unless otherwise specified, all parts are by weight and all temperatures are in degrees Celsius.

Example 1

An I10 thermal transfer ribbon (available from International Imaging Materials, Inc., 310 Commerce Dr., Amherst, N.Y., 14228) was used to print lines of 0, 37, and 80 duty cycle onto a paper receiving sheet using a Zebra 140Xill thermal transfer printer (available from Zebra Technologies Corporation LLC, 333. Corporate Woods Parkway, Vernon Hills, Ill., 60061). As used herein, the term duty cycle refers to the percentage of the time that the print head elements are energize and thus cause thermal transfer.

The printer was operated at a printing speed of 8 inches per second and a darkness setting of 17. Two full ribbons, each 300 meters in length, were printed. The thermal print head was removed from the printer and examined under an optical microscope with a magnification of 50×. Microscopic examination of the array of print head heating elements revealed that, in the section of the array where the 37 and 80% duty cycle lines were printed, a build-up of blackish contamination was deposited. No such build-up was observed in the areas where no thermal transfer printing was done (i.e. the zero percent duty cycle areas). The printhead was reinstalled into the printer.

A 12 inch long and 4 inch wide sheet of Hop Syn DLI grade Duralite synthetic paper with a thickness of 5.9 mils and a Sheffield smoothness of 3 (that was purchased from Hop Industries Corporation of 174 Passaic Street, Garfield, N.J.) was placed in the printing nip of the Zebra printer. The sheet was completely pulled through the printing nip by hand at a speed of about 4 inches per second. The print head was removed from the printer, and the array of print head heating elements were examined with an optical microscope. The microscopic analysis revealed that the cleaning action of the synthetic paper cleaning sheet removed a portion of the contamination built up on the portions of the array of print head heating elements where the 80 and 37 percent duty cycle lines were printed. In addition, the microscopic examination revealed that the array of print head heating elements was not scratched by the action of the synthetic paper cleaning sheet. It was also observed that small particles from the synthetic paper cleaning sheet were deposited on the surface of the array of print head heating element. The print head was reinstalled into the printer.

Example 2

A 12 inch long and 4 inch wide sheet of a Sato printhead cleaning card with a Sheffield smoothness of 100 (obtained from the Sato Company as the "Sato Thermal Printer Cleaning Sheet") was placed in the printing nip of the Zebra printer; this cleaning sheet was found to comprise particulate alumina.

The Sato cleaning sheet was completely pulled through the printing nip by hand at a speed of about 4 inches per second. The print head was removed from the printer, and the array of print head heating elements were examined with an optical microscope. The microscopic analysis revealed that the cleaning action of the Sato cleaning card removed a significant portion of the contamination built up on the portions of the array of print head heating elements where the 80 and 37 percent duty cycle lines were printed. In addition, the microscopic examination revealed that the array of print head heating elements was severely scratched by the action of the Sato cleaning card. It was also observed that no small particles from the Sato cleaning card were deposited on the surface of the array of print head heating element. The print head was reinstalled into the printer.

Example 3

In substantial accordance with the procedure described in Example 1, a cleaning assembly was made in accordance with the procedure of such example and was evaluated. In this experiment, no thermal transfer ribbon was actually printed, but 400 meters of the synthetic paper cleaning assembly of Example 1 was pulled past and through the nip of the printer. By comparison, in Example 2 only about 12 inches of the Sato cleaning sheet was actually contacted with the print head.

Despite an exposure which was at least 120 times as great to the cleaning assembly of Example 2, inspection of the print head revealed no scratching or damage to the array of print head heating elements. The print head was reinstalled in the printer and found to be completely operational with no deterioration of performance (when compared to the performance of the print head before the 400 meters of synthetic paper cleaning assembly was pulled through the printer nip).

Example 4

In substantial accordance with the procedure described in Example 1, a cleaning ribbon was prepared; however, a 3.1 mil thickness of "DURALITE DLI GRADE" paper was used rather than the 5.9 mil thickness used in Example 1, and this paper had a Sheffield smoothness of 43. This ribbon had the following dimensions: a width of 4 inches, and a length of 9 inches.

The ribbon thus prepared was attached as the beginning section to a thermal printing ribbon sold as "VERSAMARK THERMAL TRANSFER RIBBON" by the International Imaging Materials Corporation of Amherst, N.Y. The thermal printing ribbon had a width of 4 inches and a length of 300 meters.

This composite ribbon, which is somewhat illustrated in FIG. 6, was run through the Zebra 140. Xill printer described in Example 1; first the cleaning leader section was pull by hand through the printer nip and then the ribbon section was used to print the line pattern referred to in Example 1. All 300 meters of ribbon were used to print this line pattern on 4" wide by 6" long label stock.

This process was repeated 39 times, until a total of 40 such composite ribbons had been used in the Zebra printer. A total of 12,000 meters of composite ribbon was used in this experiment.

In this experiment, as was done in the experiment of Example 1, the cleaning section was pulled past the print head, while the printing section was thermally printed.

After so testing the 40 composite ribbons, the print head was examined. No scratching of or damage to the print head was found.

Example 5

Prior to preparing the coating fluid described below, it is advantageous to make two of the components included in the final composition. A 15% solution of Mowiol 3-96, a fully hydrolyzed polyvinyl alcohol (purchased from Clariant Corporation, 4000 Monroe Road, Charlotte, N.C.) was prepared by weighing 170 grams of cold water into a Pyrex container. The container was placed on a hot plate equipped with a magnetic stirrer. Into a separate container was placed 30 grams of Mowiol 3-96. The Mowiol was added to the cold water while stirring at medium to high speed. The mixture was brought to a temperature of 85° C. This temperature was maintained for approximately 45 minutes or until a clear, complete solution is formed. The mixture was cooled to room temperature before use.

The next component is a clay dispersion comprising 225 grams of 15.0% fully hydrolyzed polyvinyl alcohol solution described above, 380 grams of dry Burgess 17 hydrous kaolin clay (purchased from Dartech, Inc 16485. Rockside Rd, Cleveland, Ohio) with an average particle size of 0.65 microns and G.E. brightness of 90.0%, 380 grams of dry APEX K hydrous kaolin clay with an average particle size of 3.0 microns and G.E. brightness of 79.0% (also purchased from Dartech, Inc). This mixture was incorporated into 703 grams of tap water and mixed with a high shear stirrer for 1 hour until a smooth, homogenous dispersion was obtained with a total solids content of 47.0%.

A coating fluid was prepared by mixing 9.00 grams of Cartaseal TPU Liquid (an aqueous proprietary formulation containing an acrylic emulsion purchased from Clariant Corporation, 4000 Monroe Road, Charlotte, N.C.) at 37.0% solids with 16.88 grams of the previously described clay dispersion. Thereafter, 0.91 grams of Hidorin H-526, a 44.0% aqueous dispersion of zinc stearate (purchased from Cytech, Inc, 906 Peterson Dr., Elizabethtown, Ky.) was incorporated with mild agitation. Thereafter, 0.139 grams of 40.0% Zonyl FSN, a fluoro surfactant (manufactured by E.I.

Dupont, purchased from Chem Central of Buffalo, N.Y.) and 1.38 grams of 20.0% Leucophor BCR optical brightener (purchased from Clariant Corporation) were added. Finally, 11.67 grams of tap water was added to the mixture to adjust the final solids content of the coating fluid to 30.0%.

The coating fluid was applied to a 150 micron white opaque, linearly oriented polypropylene synthetic paper (purchased from HOP Industries, 174 Passaic St, Garfield, N.J.) using a #5 wire wound meyer coating rod and dried with a hot air gun for 1 minute to for the cleaning strip of this example. The final dry coat weight achieved was between 0.80–1.0 gsm.

Coating adhesion to the substrate was tested by scoring a crosshatch pattern with a razor knife, through the coating, avoiding excessive penetration into the base substrate. Adhesion was evaluated by placing a piece of 3M 610 tape (purchased from 3M, 3M Center, St. Paul, Minn.). Onto the scored surface and a plastic roller was used to ensure intimate contact. After a five (5) minute dwell time the tape was briskly peeled away at a rate of approximately eight (8) inches per second. Both the tape and the scored surface were observed. In this example, no coating was removed or disrupted from the surface of the substrate. Surface smoothness of the coated side of the cleaning strip was tested using a Sheffield SmoothCheck. A Sheffield smoothness of 30 to 35 was obtained on this example.

On a Zebra 140. Xill thermal transfer printer 450 meters of Fast Wax thermal transfer ribbon (obtained from IIMAK, 310. Commerce Dr., Amherst, N.Y. 14228) was used to print a full width rotated bar code onto a paper receiver (Fasson TT1C) at a speed of 5 cm/sec and a printer darkness setting of 30. The print head was removed from the printer and examined with an optical microscope with a magnification of 50×. Photomicrographs of the printhead revealed a build-up of backcoat material on the heat line of the printhead. The printhead was not otherwise damaged or scratched. The printhead was reinstalled in the printer and four 20 cm long by 1.5 cm wide cleanings strips were sequentially placed in the printing nip of the Zebra printer. The strips were completely pulled through the printing nip by hand at a speed of about 10 cm per second. The print head was removed from the printer, and the array of print head heating elements were examined with an optical microscope. The microscopic analysis revealed that the cleaning action of the cleaning strip removed a significant portion of the contamination built up on the portions of the array of print head heating elements that were previously contaminated by the action of printing the Fastwax ribbon. In addition, the microscopic examination revealed that the array of print head heating elements was not scratched by the action of the cleaning strip. It was also observed that no small particles from the cleaning strip were deposited on the surface of the array of print head heating element. The print head was reinstalled into the printer.

Example 6

Prior to preparing the coating fluid described below, it is necessary to make two of the components included in the final composition. A 15% solution of Mowiol 3-96, a fully hydrolyzed polyvinyl alcohol (purchased from Clariant Corporation, 4000 Monroe Road, Charlotte, N.C.) was prepared by weighing 170 grams of cold water into a Pyrex container. The container was placed on a hot plate equipped with a magnetic stirrer. Into a separate container was placed 30 grams of Mowiol 3-96. The Mowiol was added to the cold water while stirring at medium to high speed. The mixture was brought to a temperature of 85° C. This temperature was maintained for approximately 45 minutes or until a clear, complete solution is formed. The mixture was cooled to room temperature before use.

The next component is a clay dispersion comprising 225 grams of 15.0% fully hydrolyzed polyvinyl alcohol solution described above, 620 grams of dry APEX K hydrous kaolin clay with an average particle size of 3.0 microns and G.E. brightness of 79.0% (also purchased from Dartech, Inc). This mixture was incorporated into 703 grams of tap water and mixed with a high shear stirrer for 1 hour until a smooth, homogenous dispersion was obtained with a total solids content of 47.0%.

A coating fluid was prepared by mixing 9.00 grams of Cartaseal TPU Liquid (an aqueous proprietary formulation containing an acrylic emulsion purchased from Clariant Corporation, 4000 Monroe Road, Charlotte, N.C.) at 37.0% solids with 16.88 grams of the previously described clay dispersion. Thereafter, 0.91 grams of Hidorin H-526, a 44.0% aqueous dispersion of zinc stearate (purchased from Cytech, Inc, 906 Peterson Dr., Elizabethtown, Ky.) was incorporated with mild agitation. Thereafter, 0.139 grams of 40.0% Zonyl FSN, a fluoro surfactant (manufactured by E.I. Dupont, purchased from Chem Central of Buffalo, N.Y.) and 1.38 grams of 20.0% Leucophor BCR optical brightener (purchased from Clariant Corporation) were added. Finally, 11.67 grams of tap water was added to the mixture to adjust the final solids content of the coating fluid to 30.0%.

The coating fluid was applied to a 150 micron white opaque, linearly oriented polypropylene synthetic paper (purchased from HOP Industries, 174 Passaic St, Garfield, N.J.) using a #5 wire wound meyer coating rod and dried with a hot air gun for 1 minute to for the cleaning strip of this example. The final dry coat weight achieved was between 0.80–1.0 gsm.

Coating adhesion to the substrate was tested by scoring a crosshatch pattern with a razor knife, through the coating, avoiding excessive penetration into the base substrate. Adhesion was evaluated by placing a piece of 3M 610 tape (purchased from 3M, 3M Center, St. Paul, Minn.) onto the scored surface and a plastic roller was used to ensure intimate contact. After a five (5) minute dwell time the tape was briskly peeled away at a rate of approximately 20 cm per second. Both the tape and the scored surface were observed. In this example, no coating was removed or disrupted from the surface of the substrate. Surface smoothness of the coated side of the cleaning strip was tested using a Sheffield SmoothCheck. A Sheffield smoothness of 80 to 85 was obtained on this example.

On a Zebra 140. Xill thermal transfer printer 450 meters of Fast Wax thermal transfer ribbon (obtained from IIMAK, 310 Commerce Dr., Amherst, N.Y. 14228) was used to print a full width rotated bar code onto a paper receiver (Fasson TT1C) at a speed of 5 cm/sec and a printer darkness setting of 30. The print head was removed from the printer and examined with an optical microscope with a magnification of 50×. Photomicrographs of the printhead revealed a build-up of backcoat material on the heat line of the printhead. The printhead was not otherwise damaged or scratched. The printhead was reinstalled in the printer and four 20 cm long by 1.5 cm wide cleanings strips were sequentially placed in the printing nip of the Zebra printer. The strips were completely pulled through the printing nip by hand at a speed of about 10 cm per second. The print head was removed from the printer, and the array of print head heating elements were examined with an optical microscope. The microscopic analysis revealed that the cleaning action of the cleaning strip removed a significant portion of the contamination built up on the portions of the array of print head heating elements that were previously contaminated by the action of printing the Fastwax ribbon. Compared with example 5, the cleaning strip of this example removed noticeably more of the contamination build up. In addition, the microscopic examination revealed that the array of print head heating elements was not scratched by the action of the cleaning strip. It was also observed that no small particles from the cleaning strip were deposited on the surface of the array of print head heating element. The print head was reinstalled into the printer.

Example 7

In accordance with the procedure used in Example 6, a Sato printhead cleaning strip with a Sheffield smoothness of 140 to 145 (obtained from the Sato Company as the "Sato Thermal Printer Cleaning Sheet") was placed in the printing nip of the Zebra printer; this cleaning sheet was found to comprise particulate alumina. The strips were completely pulled through the printing nip by hand at a speed of about 10 cm per second. The print head was removed from the printer, and the array of print head heating elements were examined with an optical microscope. The microscopic analysis revealed that the cleaning action of the Sato cleaning card removed a significant portion of the contamination built up on the portions of the array of print head heating elements where the 80 and 37 percent duty cycle lines were printed. In addition, the microscopic examination revealed that the array of print head heating elements was severely scratched by the action of the Sato cleaning card. It was also observed that no small particles from the Sato cleaning card were deposited on the surface of the array of print head heating element. The print head was reinstalled into the printer.

The scope of applicants' invention is indicated by the appended claims, not by the foregoing description and drawings. All changes which come within the meaning and range of equivalents of the claims are therefore intended to be embraced therein.

We claim:

1. A thermal printing assembly comprised of a first flexible section, wherein: said first flexible section is comprised of a first side, and a second side, wherein: said first side is comprised of a multiplicity of first particles disposed therein, and wherein said particles have a Knoop hardness of less than about 800 wherein at least about 90 percent by weight of said first particles are smaller than about 100 microns and at least about 100 of said first particles per square millimeter of said first side are present on said first side and are homogeneously distributed over said first side, further comprising a second flexible section which is comprised of a thermally sensitive media selected from the group consisting of a thermal transfer ribbon, dye sublimation ribbon, and a direct thermal sensitive substrate.

2. The thermal printing assembly as recited in claim 1, wherein said first side has a Sheffield smoothness of less than about 100 Sheffield units.

3. The thermal printing assembly as recited in claim 1 wherein said second side has an adhesive applied thereon.

4. The thermal printing assembly as recited in claim 3 wherein said adhesive is a pressure sensitive adhesive.

5. The thermal printing assembly as recited in claim l, wherein said thermally sensitive media is a thermal transfer ribbon comprised of an imaging side and a backside and wherein said first side of said first flexible section is congruent with said backside of said thermal transfer ribbon.

6. The thermal printing assembly as recited in claim 5, wherein at least about 90 percent by weight of said first particles are smaller than about 15 microns.

7. The thermal printing assembly as recited in claim 6, wherein said first particles have a Knoop hardness of less than about 150.

8. The thermal printing assembly as recited in claim 7, wherein at least about 1000 of said first particles per square millimeter of said first side are present on said first side and are homogeneously distributed over said first side.

9. The thermal printing assembly as recited in claim 8, wherein said first side has a Sheffield smoothness of less than about 30.

10. The thermal printing assembly as recited in claim 5, wherein said first flexible section is comprised of a flexible support.

11. The thermal printing assembly as recited in claim 10, wherein said flexible support is a flexible polymeric support comprised of polymeric material.

12. The thermal printing assembly as recited in claim 11, wherein said polymeric material is selected from the group consisting of poly(ethyelene terephthalate), polypropylene, polyolefins, cellophane, polycarbonate, cellulose acetate, polyethylene, polyvinyl chlonde. polystyrene, polyimide, polyvinylidene chloride, polyvinyl alcohol, fluororesin, chlorinated resin, ionomer, and mixtures thereof.

13. The printing assembly as recited in claim 10, wherein said flexible support is a flexible paper.

14. The printing assembly as recited in claim 10, wherein said flexible support is coated with a first layer to form said first side; said first layer is comprised of a first binder wherein; said first side has a Sheffield smoothness of less than about 100 Sheffield unit.

15. The printing assembly as recited in claim 5, wherein said first particles are inorganic particles.

16. The printing assembly as recited in claim 15, wherein said inorganic particles are selected from the group consisting of calcium carbonate particles, mica particles, talc particles, clay particles, and mixtures thereof.

17. The printing assembly as recited in claim 5, wherein said first particles are organic particles.

18. The printing assembly as recited in claim 17, wherein said organic particles are selected from the group consisting of polystyrene particles, polymethylmethacrylate particles, poly (n-butyl acrylate) particles, polybutadiene particles, poly (divinylbenzene) particles, cellulose acetate particles, and mixtures thereof.

19. The printing assembly as recited in claim 5, wherein said first particles comprise inorganic particles and organic particles.

20. The printing assembly as recited in claim 5, wherein said first flexible section is comprised of a synthetic paper.

21. The printing assembly as recited in claim 20, wherein said synthetic paper is an oriented polypropylene synthetic paper.

22. The printing assembly as recited in claim 20, wherein said synthetic paper is a polyethylene based synthetic paper.

23. The printing assembly as recited in claim 5, wherein said first flexible section is joined to said second flexible section by splicing tape.

24. The thermal printing assembly as recited in claim 1, wherein said thermally sensitive media is a direct thermal sensitive substrate comprised of an imaging side and a backside and wherein said first side of said first flexible section is congruent with said imagining side of said direct thermal sensitive substrate.

25. The thermal printing assembly as recited in claim 1, wherein said first particles have a Knoop hardness of less than about 500.

26. The thermal printing assembly as recited in claim 1, wherein said first side has a Sheffield smoothness of less than about 50.

27. The thermal printing assembly as recited in claim 26, wherein said first flexible section has a thickness of less than about 500 microns.

28. The thermal printing assembly as recited in claim 27, wherein said first flexible section has a thickness of from about 100 to about 175 microns.

29. The thermal printing assembly as recited in 1, wherein said thermally sensitive media is a dye sublimation ribbon comprised of an imaging side and a backside and wherein said first side of said first flexible section is congruent with said backside of said dye sublimation ribbon.

30. The thermal printing assembly as recited in claim 1, further comprising a third flexible section comprised of a third side wherein said third side is comprised of a platen roller cleaning adhesive.

31. A thermal printing assembly comprised of a first flexible section, wherein: said first flexible section is comprised of a first side, and a second side, wherein: said first side is comprised of a multiplicity of first particles disposed therein, and said particles have a Knoop hardness of less than about 800, further comprising a second flexible section which is comprised of a thermal transfer ribbon comprised of an imaging side and a backside and wherein said first side of said first flexible section is congruent with said backside of said thermal transfer ribbon, wherein said first flexible section is comprised of opacification particles with a refractive index greater than 1.4.

32. A thermal printing assembly comprised of a first flexible section, wherein: said first flexible section is comprised of a first side, and a second side, wherein: said first side is comprised of a multiplicity of first particles disposed therein, and wherein said particles have a Knoop hardness of less than about 800 further comprising a second flexible section wherein a. said second flexible section is congruent with said first flexible section, b. said second flexible section is comprised of a third side and a fourth side, wherein I. said third side has a Sheffield smoothness of less than about 85 Sheffield units, II. said third side is comprised of a multiplicity of second particles disposed therein, and wherein said second particles have a Knoop hardness of less than about 700.

33. The printing assembly as recited in claim 32 wherein said thermal printing assembly is comprised of a third flexible section joined to said second flexible section, and wherein said third flexible section is comprised of a thermally sensitive media selected from the group consisting of a thermal transfer ribbon, a dye sublimation ribbon and a direct thermal sensitive substrate.

34. The thermal printing assembly as recited in claim 33, wherein said thermally sensitive media is a thermal transfer ribbon comprised of an imaging side and a backside and wherein said first side of said first flexible section is congruent with said backside of said thermal transfer ribbon.

35. The printing assembly as recited in claim 33 wherein said first flexible section and said second flexible section are comprised of an adhesive side wherein said adhesive side is comprised of a platen roller cleaning adhesive.

36. A thermal printing assembly comprised of a first flexible section, wherein: said first flexible section is comprised of a first side, and a second side, wherein: said first side is comprised of a multiplicity of first particles disposed therein, and wherein said particles have a Knoop hardness of less than about 800, further comprising a second flexible section joined to said first flexible section, and wherein said second flexible section is comprised of a thermal transfer ribbon comprised of an imaging side and a backside and wherein said first side of said first flexible section is congruent with said backside of said thermal transfer ribbon, wherein said first flexible section is comprised of a clay modified polypropylene synthetic paper.

37. The printing assembly as recited in claim 36, wherein said synthetic paper has a Sheffield smoothness of less than about 50.

38. A thermal printing assembly comprised of a first flexible section, wherein: said first flexible section is comprised of a first side, and a second side, wherein: said first side is comprised of a multiplicity of first particles disposed therein, and wherein said particles have a Knoop hardness of less than about 800, wherein said thermal printing assembly is also comprised of a second flexible section wherein: said second flexible section is comprised of a third side which is comprised of a multiplicity of second particles disposed therein, and wherein said second particles have a Knoop hardness of less than about 800.

39. The printing assembly as recited in claim 38, wherein said first particles have an average particle size that differs from the average particles size of said second particles.

40. The printing assembly as recited in claim 38, wherein said first particles have a chemical composition that differs from the chemical composition of said second particles.

41. A thermal printing assembly comprised of a first flexible section, a second flexible section comprised of a thermally sensitive media joined to said first flexible section, and a third flexible section comprised of a third side, wherein: said first flexible section is comprised of a first side and a second side, wherein said first side is comprised of a multiplicity of first particles disposed therein, and said particles have a Knoop hardness of less than about 800, wherein said thermally sensitive media is selected from the group consisting of a thermal transfer ribbon, dye sublimation ribbon, and a direct thermal sensitive substrate, wherein said third side is comprised of a platen roller cleaning adhesive, wherein said third side is congruent with said first side of said first flexible section and wherein said third side is congruent with said second side of said first flexible section.

42. The thermal printing assembly as recited in claim 41, wherein said thermally sensitive media is selected from the group consisting of a thermal transfer ribbon and dye sublimation ribbon, and said third side of said third flexible section is congruent with said imaging side of said thermally sensitive media.

43. The thermal printing assembly as recited in claim 41, wherein said thermally sensitive media is a direct thermal sensitive substrate and said third side of said third flexible section is congruent with said backside of said thermally sensitive media.

44. A thermal printing assembly comprised of a thermal transfer ribbon and a multiplicity of flexible sections, wherein:

a. each of said flexible sections have a first side and a second side, wherein:

i. said first sides have a Sheffield smoothness of less than about 100 Sheffield units, ii. said first sides are comprised of a multiplicity of first particles disposed therein, and wherein said particles have a Knoop hardness of less than about 800, and at least about 100 of said first particles per square millimeter of said first sides are present on said first sides and are homogeneously distributed over said first sides, b. said thermal transfer ribbon is comprised of an imaging side and a backside and wherein i. said thermal transfer ribbon is congruent with said flexible sections, ii. said imaging side of said thermal transfer ribbon is congruent with said first sides of said flexible sections.

45. A thermal printing assembly comprised of a direct thermal media and a multiplicity of flexible sections, wherein:

a. each of said flexible sections have a first side and a second side, wherein:

i. said first sides have a Sheffield smoothness of less than about 100 Sheffield units, ii. said first sides are comprised of a multiplicity of first particles disposed therein, and wherein said particles have a Knoop hardness of less than about 800, and at least about 100 of said first particles per square millimeter of said first sides are present on said first sides and are homogeneously distributed over said first sides, b. said direct thermal media is comprised of an imaging side and a backside and wherein i. said direct thermal media is congruent with said flexible sections, ii. said imaging side of said direct thermal media is congruent with said first sides of said flexible sections.

46. A thermal printing product, comprising:

a. a first flexible section having a non-abrasive surface for removing material from a thermal print head, said non-abrasive surface having a Sheffield smoothness of less than about 100; said non-abrasive surface being comprised of at least about 100 soft particles per square millimeter of said non-abrasive surface homogeneously distributed over said non-abrasive surface, said particles having a Knoop hardness of less than about 800, and b. a second flexible section having a surface for contacting said thermal print head, said second flexible section comprising a thermally sensitive media, said second flexible section being congruent with said first flexible section.

47. The product of claim 46, wherein said non-abrasive surface is comprised of synthetic paper.

48. A method of operating a thermal printing device, said method comprising the steps of:

a. locating a first flexible section and a second flexible section in a thermal printing device, wherein said thermal printing device is comprised of a thermal print head, and said second flexible section is comprised of a thermally sensitive media;

b. moving said first flexible section relative to said thermal print head, such that a non-abrasive surface, having a Sheffield smoothness of less than about 100 and at least about 100 soft particles per square millimeter of said non-abrasive surface homogeneously distributed over said non-abrasive surface,and said particles have a Knoop hardness of less than about 800, removes material from said thermal print head; and c. printing indicia by moving said second flexible section relative to said thermal print head.

49. The method of claim 48, wherein said printing step occurs subsequent to said step of moving said first flexible section.

50. The method of claim 48, wherein said step of moving said first flexible section occurs subsequent to said printing step.

51. The method of claim 48, wherein said printing step is comprised of the step of using a thermal transfer ribbon.

52. The method of claim 48, wherein said second flexible section is a thermally sensitive media selected from the group consisting of a thermal transfer ribbon, dye sublimation ribbon, and a direct thermal sensitive substrate.

53. A method of operating a thermal printing device, said method Comprising the steps of:

a. locating a first flexible section and a second flexible section in a thermal printina device, wherein said thermal printing device is comprised of a thermal print head;

b. moving said first flexible section relative to said thermal print head, such that a non-abrasive surface, having a Sheffield smoothness of less than about 100, removes material from said thermal print head; and c. printing indicia by moving said second flexible section relative to said thermal print head, wherein said printing step is comprised of the step of using a direct thermal sensitive substrate.

54. A thermal printing product comprising: a first flexible section having a non-abrasive surface for removing material from a thermal print head, said non-abrasive surface is cormprised of at least about 100 soft particles per square millimeter of said non-abrasive surface homogeneously distributed over said non-abrasive surface, wherein said soft particles have a Knoop hardness of less than about 800; and a second flexible section having a surface for contacting said thermal print head, said second flexible section being comprised of thermally sensitive media, said second flexible section being connected to said first flexible section.

55. The product of claim 54 where in said non-abrasive surface having a Sheffield smoothness of less than about 100.

56. The product of claim 54, wherein said non-abrasive surface is comprised of synthetic paper.

57. A thermal printing assembly comprised of a first flexible section and a second flexible section, wherein:

a. said first flexible section is comprised of a first side, and a second side, wherein:

i. said first side is comprised of a multiplicity of first particles disposed therein, and ii. said particles have a Knoop hardness of less than about 800, iii. said second side is comprised of platen roller cleaning adhesive, b. said second flexible section is comprised of a thermally sensitive media.

58. The thermal printing assembly as recited in claim 57, wherein said thermally sensitive media is selected from the group consisting of a thermal transfer ribbon and dye sublimation ribbon, and said second side of said first flexible section is congruent with said imaging side of said thermally sensitive media.

59. The thermal printing assembly as recited in claim 57, wherein said thermally sensitive media is a direct thermal sensitive substrate, and said second side of said first flexible section is congruent with said backside of said thermally sensitive media.

60. The thermal printing assembly as recited in claim 57, wherein at least about 100 of said first particles per square millimeter of said first side are present on said first side and are homogeneously distributed over said first side.

* * * * *